US011785980B1

(12) United States Patent
Niehaus et al.

(10) Patent No.: US 11,785,980 B1
(45) **Date of Patent: *Oct. 17, 2023**

(54) METHOD AND APPARATUS FOR PREPARING A CONICALLY SHAPED SMOKING SHELL WITH BLOCKING TIP

(71) Applicant: LSR HC LLC, Mandeville, LA (US)

(72) Inventors: Michael Niehaus, Lebanon, OH (US); Randall Bachtel, Lawrenceville, GA (US); John Hersman, Blue Ash, OH (US); Trent Warncke, Lebanon, OH (US); Joseph Bullard, West Chester, OH (US)

(73) Assignee: LSR HC LLC, Mandeville, LA (US)

( * ) Notice: Subject to any disclaimer, the term of this patent is extended or adjusted under 35 U.S.C. 154(b) by 120 days.

This patent is subject to a terminal disclaimer.

(21) Appl. No.: 17/398,087

(22) Filed: Aug. 10, 2021

Related U.S. Application Data

(63) Continuation of application No. 16/705,360, filed on Dec. 6, 2019, now Pat. No. 11,083,212.
(Continued)

(51) Int. Cl.
*A24C 1/26* (2006.01)
*A24C 1/32* (2006.01)
(Continued)

(52) U.S. Cl.
CPC ..... *A24C 1/26* (2013.01); *A24C 1/32* (2013.01); *A24C 5/30* (2013.01); *A24D 1/022* (2013.01)

(58) Field of Classification Search
CPC .... A24C 1/26; A24C 1/32; A24C 5/40; A24C 5/44; A24C 5/46; A24C 5/465
See application file for complete search history.

(56) References Cited

U.S. PATENT DOCUMENTS 2,035,211 A * 3/1936 Aivaz ..... A24C 5/465 131/72
2011/0056504 A1* 3/2011 Laplante ..... A24C 5/40 131/70

(Continued)

*Primary Examiner* — Eric Yaary
(74) *Attorney, Agent, or Firm* — Roy Kiesel Ford Doody & North, APLC; Brett A. North

(57) ABSTRACT

In one embodiment is provided an apparatus which forms conically shaped smoking shells having blocking tips, the apparatus including: (i) a conical form mandrel having an exterior surface, an interior section, and a vacuum opening fluidly connecting the interior section with the exterior surface; (ii) a motor operably connected to the conical form mandrel which can rotate the conical form mandrel; (iii) a conical form mandrel vacuum system operably connected to the interior section of conical form mandrel; (iv) a vacuum table having an upper surface, a vertical elevation system operably connected to the upper surface, which vertical elevation system vertically positions the upper surface, and table heater supported by the vacuum table, and a table vacuum system operably connected to the upper surface; and (v) a garage system located next to the conical form mandrel, the garage system including a base and a garage carriage slidingly connected to the base, the garage carriage including first and second ends with an internal opening extending from the first to the second end, an a squeeze lock connected to the garage carriage and the apparatus is used to form conical smoking shells.

20 Claims, 39 Drawing Sheets

Related U.S. Application Data

(60) Provisional application No. 62/777,503, filed on Dec. 10, 2018.

(51) Int. Cl.
*A24C 5/30* (2006.01)
*A24D 1/02* (2006.01)

(56) References Cited

U.S. PATENT DOCUMENTS

| | | | | |
|---|---|---|---|---|
| 2012/0006339 | A1* | 1/2012 | Sinclair, Jr. | A24D 1/002 131/280 |
| 2015/0230517 | A1* | 8/2015 | Noah | A24D 1/02 131/331 |
| 2017/0042218 | A1* | 2/2017 | Sinclair, Jr. | A24D 1/022 |

* cited by examiner

METHOD AND APPARATUS FOR PREPARING A CONICALLY SHAPED SMOKING SHELL WITH BLOCKING TIP

CROSS-REFERENCE TO RELATED APPLICATIONS

This is a continuation of U.S. non-provisional patent application Ser. No. 16/705,360 filed on Dec. 6, 2019 (issued as U.S. Pat. No. 11,083,212 on Aug. 10, 2021), which application claims the benefit of U.S. provisional patent application Ser. No. 62/777,503, filed on Dec. 10, 2018, each of which applications is incorporated herein by reference in their entirety.

STATEMENT REGARDING FEDERALLY SPONSORED RESEARCH OR DEVELOPMENT

Not applicable

REFERENCE TO A "MICROFICHE APPENDIX"

Not applicable

BACKGROUND

Conical smoking shells exist in the art but are generally hand made which slows down the manufacturing process and creates inconsistencies in the units being manufactured. It is generally desirable to automate various portions of the manufacturing process of conical smoking shells.

While certain novel features of this invention shown and described below are pointed out in the annexed claims, the invention is not intended to be limited to the details specified, since a person of ordinary skill in the relevant art will understand that various omissions, modifications, substitutions and changes in the forms and details of the device illustrated and in its operation may be made without departing in any way from the spirit of the present invention. No feature of the invention is critical or essential unless it is expressly stated as being "critical" or "essential."

BRIEF SUMMARY

The apparatus of the present invention solves the problems confronted in the art in a simple and straightforward manner. What is provided is system and method of manufacturing a smokable conical shell where at least some of the steps are automated and/or partially automated.

In one embodiment is provided a method of making a custom made cigar comprising the steps of:

(a) providing an apparatus which forms conically shaped smoking shells having blocking tips, the apparatus including:

(i) a conical form mandrel having an exterior surface, an interior section, and a vacuum opening fluidly connecting the interior section with the exterior surface;

(ii) a motor operably connected to the conical form mandrel which can rotate the conical form mandrel;

(iii) a conical form mandrel vacuum system operably connected to the interior section of conical form mandrel;

(iv) a vacuum table having an upper surface, a vertical elevation system operably connected to the upper surface, which vertical elevation system vertically positions the upper surface, and table heater supported by the vacuum table, and a table vacuum system operably connected to the upper surface;

(v) a garage system located next to the conical form mandrel, the garage system including a base and a garage carriage slidingly connected to the base, the garage carriage including first and second ends with an internal opening extending from the first to the second end, an a squeeze lock connected to the garage carriage;

(b) providing a plurality of sheets of smokable material;

(c) providing a plurality of blocking tips;

(d) selecting one of the sheets of step "b" and placing the selected sheet on the upper surface of the vacuum table;

(e) the table vacuum system pulling a partial vacuum on at least part of the upper surface of the vacuum table which partial vacuum on at least part of the upper surface of the vacuum table tends to hold in place the selected sheet on the upper surface of the vacuum table;

(f) the motor rotating the conical form mandrel;

(g) the conical form mandrel vacuum system pulling a partial vacuum on at least part of the external surface of the conical form mandrel;

(h) the partial vacuum on the external surface of the conical form mandrel connecting the selected sheet of step "d" to the conical form mandrel, wherein rotation of the conical form mandrel causing the selected sheet to be wrapped about the conical form mandrel and forming a conical shell having first and second open ends and a shell interior spanning between the first and second open ends of the conical shell;

(i) after step "h", sliding the garage in a first direction over the conical form mandrel and the conical sheet thereby causing the conical form mandrel and conical shell to at least partly enter the interior opening of the garage carriage;

(j) after step "i", while the conical shell remains at least partly located in the interior opening of the garage carriage, sliding the garage in a second direction, which second direction is generally the opposite of the first direction, thereby causing the conical shell to be separated from the conical form mandrel;

(k) after step "j", selecting one of the blocking tips from step "c", and placing the selected blocking tip inside the shell interior and, while the conical shell remains at least partly located in the interior opening of the garage carriage, sliding the garage carriage in the first direction such that the conical form mandrel enters the interior of the conical shell causing the selected tip to move towards the second end of the conical shell; and (l) after step "k", while the conical shell remains at least partly located in the interior opening of the garage carriage, sliding the garage in the second direction thereby causing the selected tip to become aligned with the second end of the conical shell.

In various embodiments, the conical form mandrel includes a vacuum slot and the conical form mandrel vacuum system is operably connected to the vacuum slot.

In various embodiments, the vacuum slot includes a foraminous slot filler which allows vacuum flow through the foraminous slot filler.

In various embodiments, steps "f", "g", and "f" are performed simultaneously, and during steps "f", "g", and "h", the motor rotates the conical form mandrel at least one revolution when.

In various embodiments, the heater heats the selected sheet.

In various embodiments, step "e" is started before step "h", and before the end of step "h", the partial vacuum on at least part of the upper surface of the vacuum table is ended.

In various embodiments, during step "b" the plurality of sheets are stacked and each of the sheets in the plurality of sheets include a line of adhesive, and during step "e" the line of adhesive on the selected sheet is activated by application of an activator to the line of adhesive.

In various embodiments, activation of the adhesive is achieved by application of water to the line of adhesive.

In various embodiments, a glue line guide is placed over the selected sheet which contacts the selected sheet but allows access to the glue line.

In various embodiments, the glue line guide is pivotally connected to the vacuum table.

In various embodiments, the vacuum table in step "h" has a first height, and the vacuum table in step "i" has a second height, and the first height is higher than the second height.

In various embodiments, the vacuum table remains at the second height during steps "i", "j", and "k".

In various embodiments, the vacuum table remains at the second height during steps "i", "j", "k", and "l".

In various embodiments, during step "a" the garage base includes a slot, and during steps"i", "j", "k", and "l", the garage carriage is guided by the slot.

In various embodiments, during step "a" the garage base includes a slot, the garage carriage includes a slot plate, and during steps"i", "j", "k", and "l", the slot plate remains in the slot.

In various embodiments, during step "a" the garage base includes a slot, the garage carriage includes a slot plate which slides in the slot of the garage base, the internal opening of the garage carriage includes first and second opening outlets respectively located at the first and second ends of the garage carriage, wherein the first outlet is larger than the second outlet, and the slot plate extends past the second end of the garage carriage.

In various embodiments, the garage base includes first and second ends, and a garage stop located at the second end of the garage base, and when the second end of the garage carriage is in contact with the garage stop, the slot plate extends past the second end of the garage base and past the garage stop.

In various embodiments, during step "a" the garage base includes a slot, the garage carriage includes a slot plate which slides in the slot of the garage base, the internal opening of the garage carriage includes first and second opening outlets respectively located at the first and second ends of the garage carriage, wherein the first outlet is larger than the second outlet, and wherein during step "k" the second end of the conical shell is caused to extend past the second opening outlet of the garage carriage.

In various embodiments, during step "a" the garage base includes a slot, the garage carriage includes a slot plate which slides in the slot of the garage base, the internal opening of the garage carriage includes first and second opening outlets respectively located at the first and second ends of the garage carriage, wherein the first outlet is larger than the second outlet, and wherein during step "k" the second end of the conical shell is caused to extend past the second opening outlet of the garage carriage, and the blocking tip partially extends past the second end of the conical shell.

In various embodiments, during step "l", contact with the second end of the conical shell is made to be flush with second opening of the garage carriage.

The drawings constitute a part of this specification and include exemplary embodiments to the invention, which may be embodied in various forms.

In various embodiments the conically shaped smoking shell with blocking tip is provided wherein the shell is comprised of smokable materials chosen from any combination of the following materials: natural leaf, homogenized tobacco paper, pipe tobacco, different types of flavored tobacco, cellulose (clear, opaque, or colored), bleached or non-bleached paper, cigarette paper, rice paper, tea leaves, *kanna*, blue lotus, salvia, salvia eivinorm, wild dagga, kratom, herbal non-tobacco, Celandine Poppy, Mugwort, Purple Lavender Flowers, Coltsfoot Leaf, Ginger root, California Poppy, Sinicuichi, St. John's Wort, *Capillarius* herba, Yerba Lenna Yesca, Calea Zacatechichi, *Leonurus* Sibericus Flowers, Wild Dagga Flowers, Klip Dagga Leaf, Damiana, Hookah, hemp, Hemia *salicifolia*, Kava Kava, *Avena sativa*, scotch broom topps, Valarian, *capillarius*, herba, Wild clip dagga, *Leonurus sibiricus, kanna*, Sinicuichi, chocolate, herbal components, and/or *Lactuca virosa*.

In various embodiments the smokable filler material used in combination with the conically shaped smoking shell with blocking tip to make the custom cigar or cigarillo is selected from any combination of the following types of filler material: smoking tobacco, pipe tobacco, different types of flavored tobacco, tea leaves, *kanna*, blue lotus, *salvia, salvia* eivinorm, wild dagga, kratom, herbal non-tobacco, Celandine Poppy, Mugwort, Purple Lavender Flowers, Coltsfoot Leaf, Ginger root, California Poppy, Sinicuichi, St. John's Wort, *Capillarius* herba, Yerba Lenna Yesca, Calea Zacatechichi, *Leonurus* Sibericus Flowers, Wild Dagga Flowers, Klip Dagga Leaf, Damiana, Hookah, Hemia *salicifolia*, Kava Kava, *Avena sativa*, scotch broom topps, Valarian, *capillarius*, herba, Wild clip dagga, *Leonurus sibiricus, Kanna*, Sinicuichi, and/or *Lactuca virosa*.

In various embodiments, the method enables an end user to make his or her own custom finished smokable scented with items such as for example apple, apple martini, berries, blueberry, champagne, chocolate, coco/vanilla, cognac, cosmo, gin, grape, honey, lychee, mango, menthol, mint choco, peach, piña colada, punch, purple, rum, strawberry/kiwi, vanilla, watermelon, wet cherry, and/or whiskey.

In various embodiments the smokable sheets can be coated and/or plated with smokable components which include but are not limited to metals such as gold.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein FIG. 1. Overall perspective of system showing base, control box, conical form mandrel attached to step motor, and vacuum plenum paper table with attached heater manual paper cone remover, and tip inserter portion with both clear movable sliding piece black base, and a vertical prong for finished conical shell storage.

DETAILED DESCRIPTION

Detailed descriptions of one or more preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in any appropriate system, structure or manner. Reference will now be made to the drawings, wherein like parts are designated by like numerals.

Figure 1:
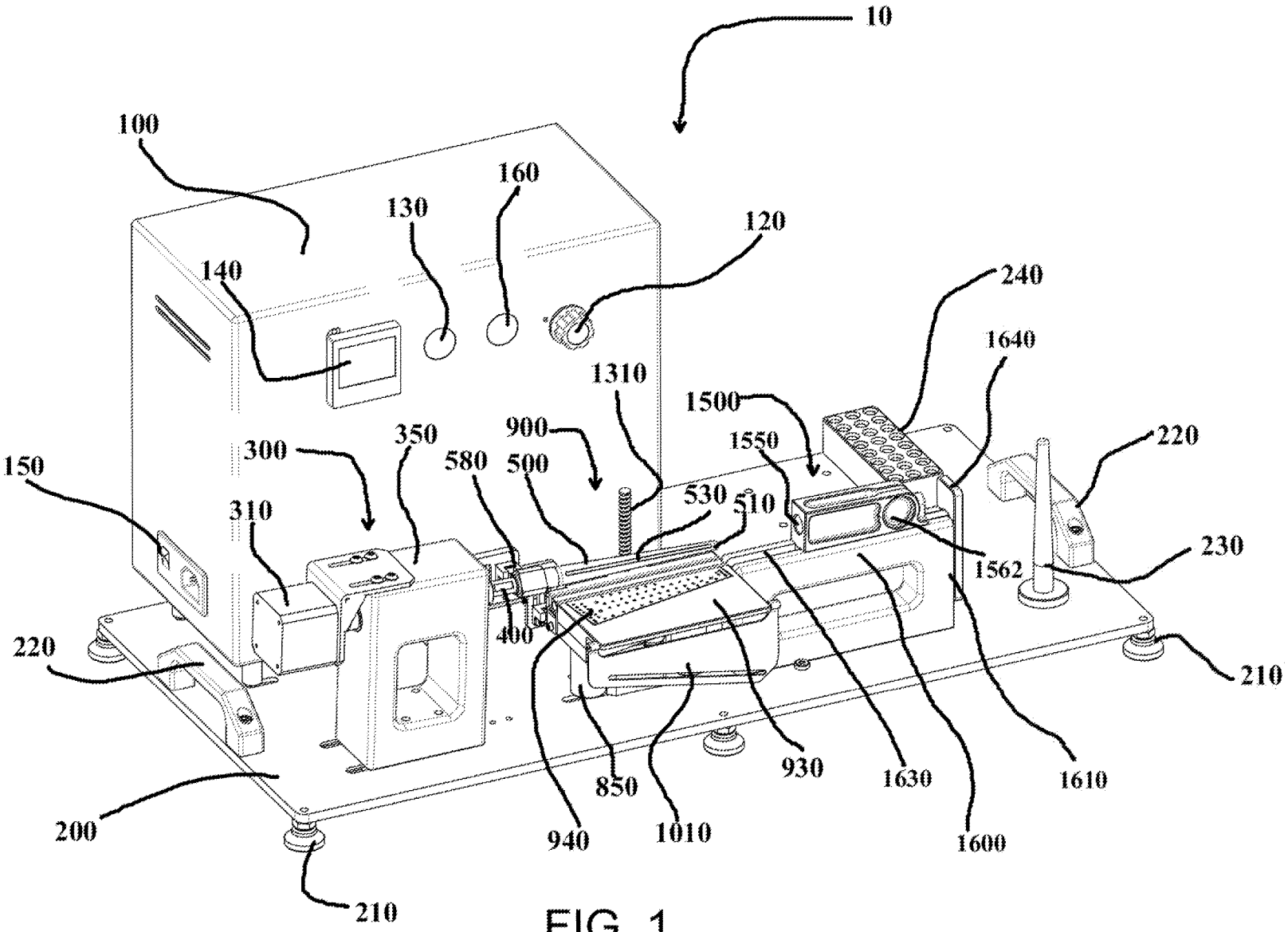

FIG. 1 shows an overall perspective of rolling machine 10 which can include base 200, controller 100, conical form mandrel 500 attached to step motor 310, and unit table 900 with attached heater unit 1100, caddy unit or garage carriage 1500, base 1600 for garage carriage, and a vertical prong 230 for finished conical shell storage.

Conical Form Mandrel

Figure 20:
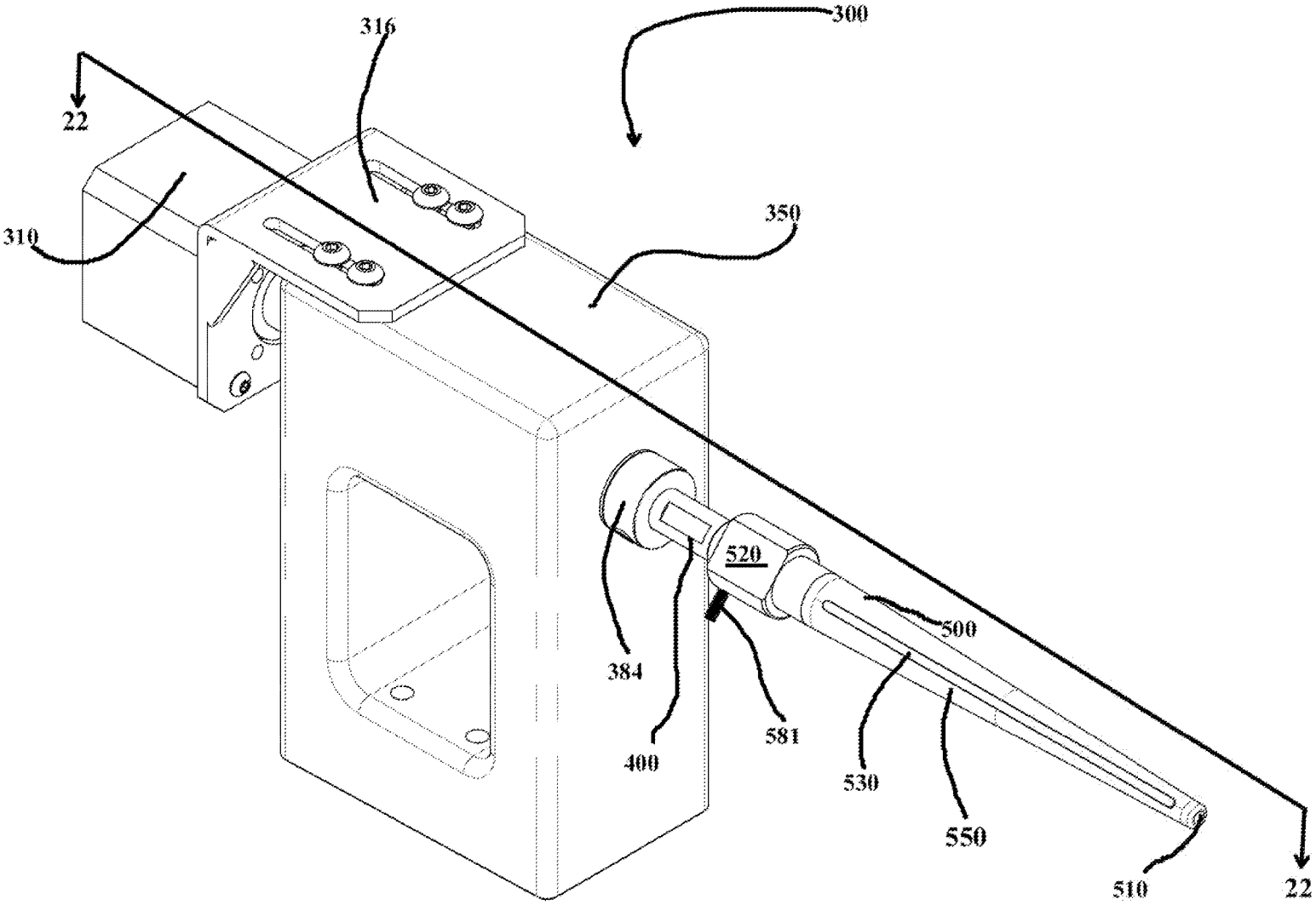
FIG. 20. Perspective of conical form mandrel attached to step motor and vacuum plenum.
Figure 21:
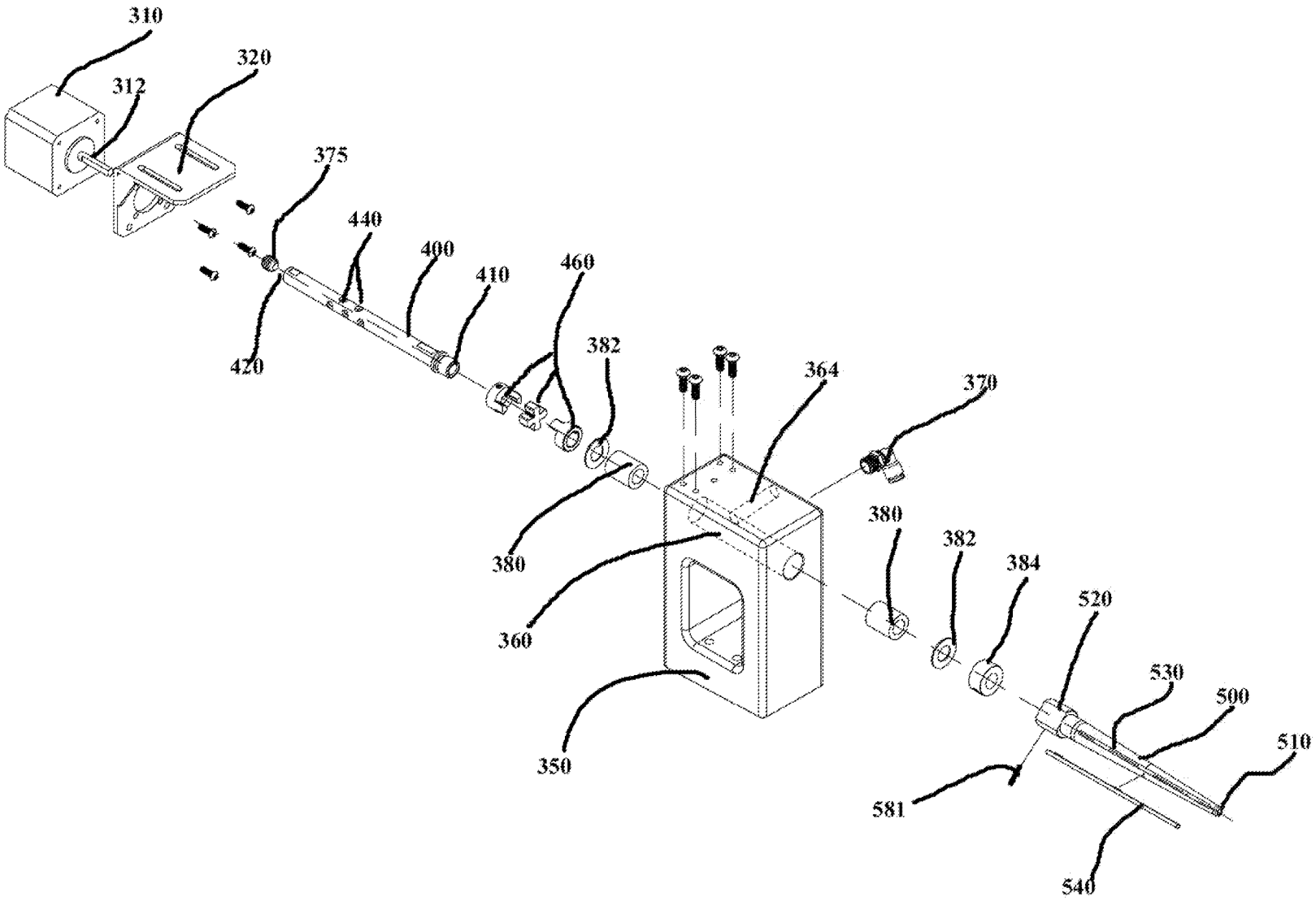
FIG. 21. Exploded view of conical form mandrel attached to step motor and vacuum plenum FIG. 22. Sectional view of conical form mandrel attached to step motor and vacuum plenum taken along the lines 22-22 shown in FIG. 20.
Figure 22:
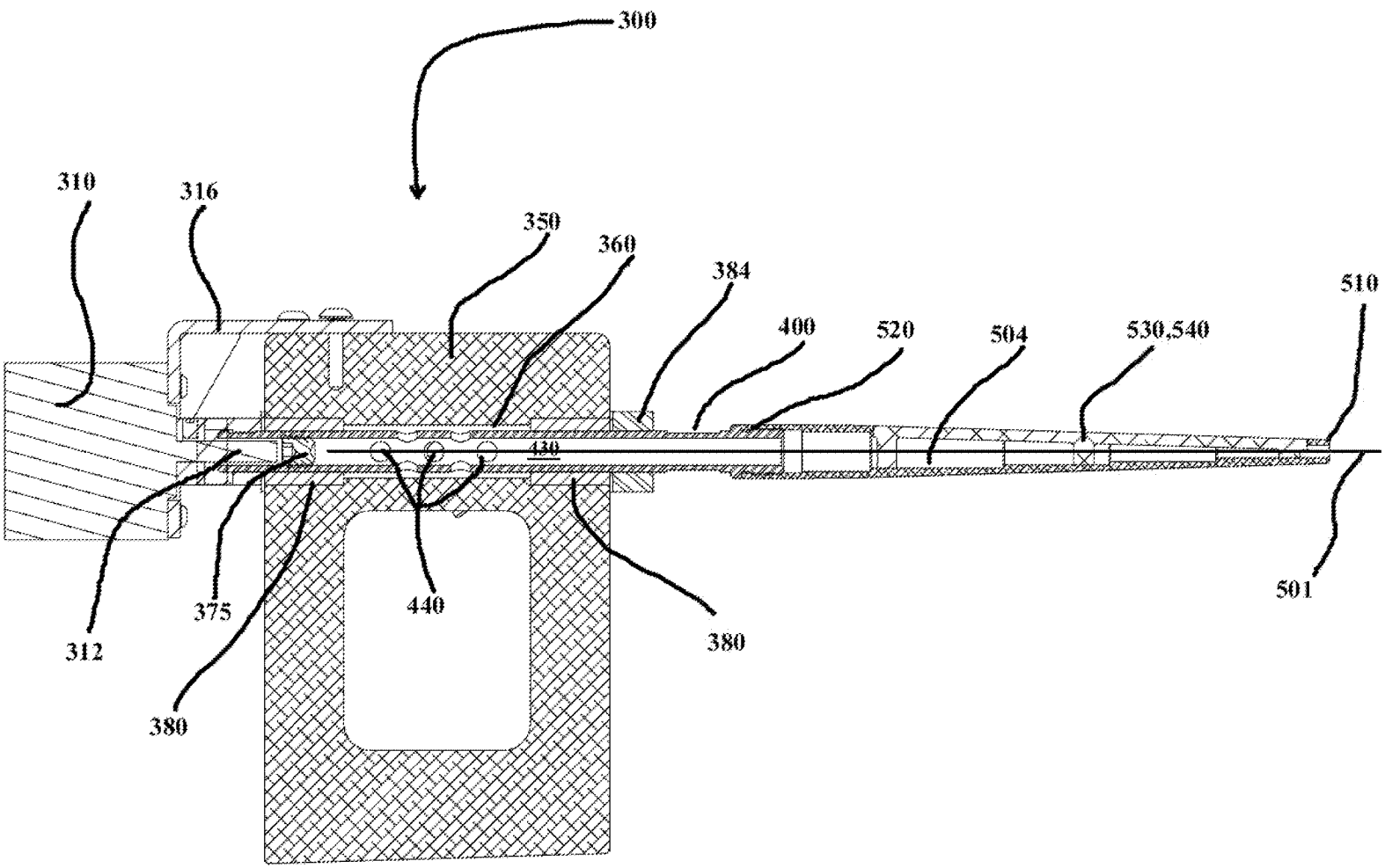

FIG. 20 is a perspective of conical form mandrel 500 attached to step motor 310 and base 350 which is attached to a vacuum system 600 (not shown). FIG. 21 is an exploded view of conical form mandrel 500 attached to step motor 310 and base 350 which is attached to a vacuum system 600 (not shown). FIG. 22 is a sectional view of conical form mandrel 500 attached to step motor 310 and base 350 which is attached to a vacuum system 600 taken along the lines 22-22 shown in FIG. 20.

Conical form mandrel 500 can include first end 510, second end 520, interior 504, exterior surface 550, and rotation sensor element 581.

Exterior surface 550 of conical form mandrel 500 can be tapered such that it has a taper 570 along its length. In various embodiments conical form mandrel 500 can have a longitudinal axis 501 which is angled relative to a horizontal plane (schematically indicated by angle 502 in FIG. 7E) such that the taper 570 at the bottom of the exterior surface 550 is horizontal. In this manner the concave recessed area 1130 of heater unit 1100 can be substantially parallel to the taper 570 at the bottom of the exterior surface 550 of conical form mandrel 500. In various embodiments angle 502 can be at least ½, 1, 1.5, 2, 3, 4, 5, 6, 7, 8, 9, and/or 10 degrees. In various embodiments angle 502 can fall within a range of between any two of the above referenced minimum angular amounts for angle 502.

Vacuum slot 530 opening to exterior surface 550 can be fluidly connected to interior 504. Vacuum slot 530 can be filled by permeable insert 540. In various embodiments permeable insert 540 can be permeable. In various embodiments insert 540 can be a foraminous metal such as conventionally available VORTEX 3 metal. In various embodiments the external surface 550 can be tapered 570 such that first end 510 has a smaller size than second end 520.

In various embodiments vacuum system 600 (not shown) can be operably connected to interior 504 of conical form mandrel. Vacuum system 600 can include a conventionally available vacuum pump which pump can be controlled by controller 100.

Motor 310 can be operably connected to conical form mandrel 500 such that motor 310 controllably rotates mandrel 500. Motor 310 can be controlled by controller 100.

Figure 7A:
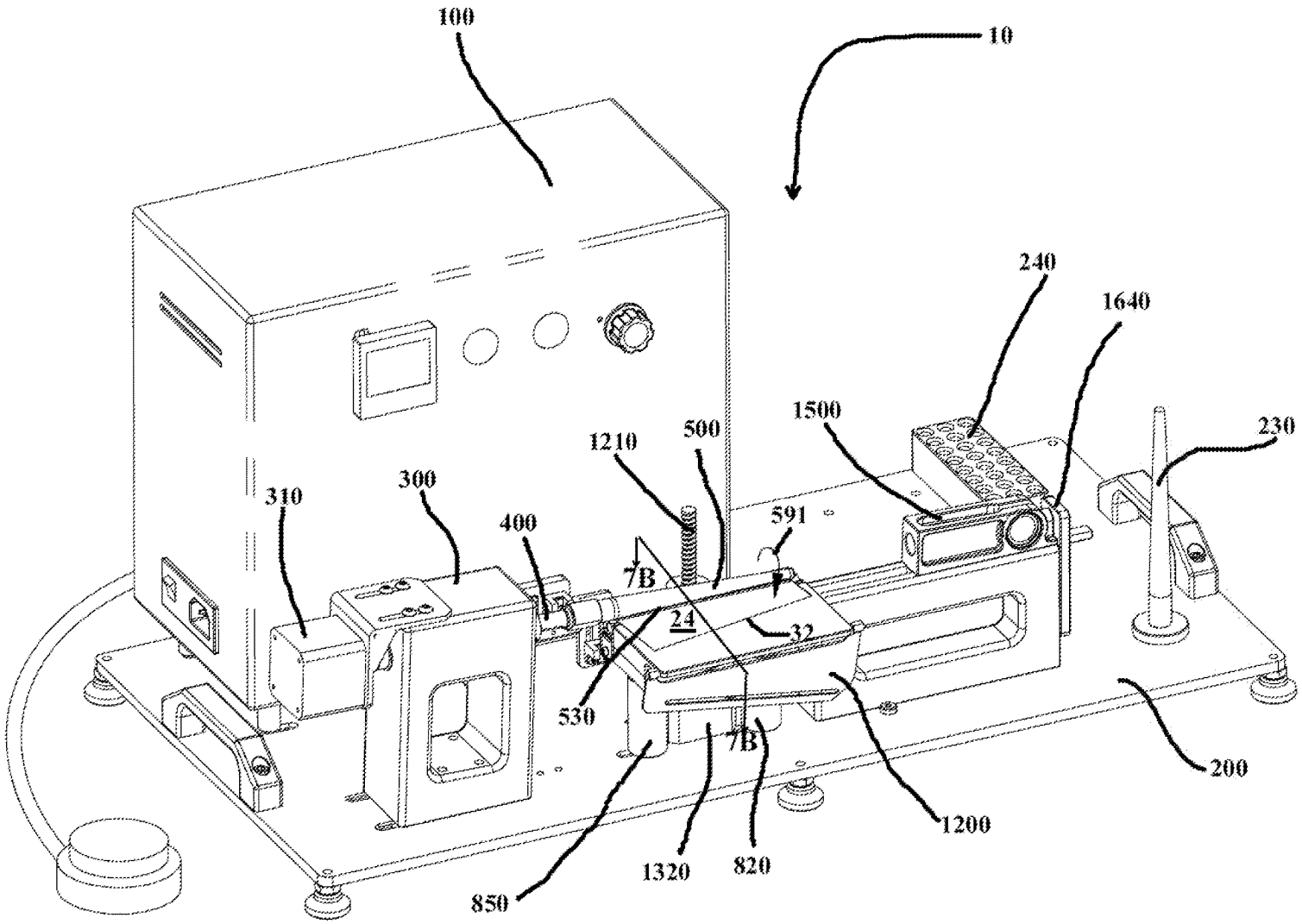
FIG. 7A. Perspective view schematically showing the conical form mandrel now having rotated to a position where the vacuum slot is closely spaced to the smokable sheet.

As shown in FIG. 21, shaft 312 of motor 310 can be attached to hollow shaft 400 where hollow shaft is rotatably connected to base 350 via bore 360 and bearings 380. Hollow shaft 400 can include a plurality of vacuum openings 440, and bore 360 can include a side bore 364, fluidly connected to inlet 370, and then fluidly connected to vacuum system 600 (not shown). As vacuum system 600 pulls a vacuum such vacuum is pulled through inlet 370, the gap between bore 360 and hollow shaft 400, the plurality of openings 440 in hollow shaft 400, the interior of hollow shaft 400, and the interior of conical form mandrel 500. FIG. 7E is a sectional view taken along the longitudinal axis of the conical form mandrel 500 and schematically showing a vacuum being pulled (schematically indicated by arrows 506) from the vacuum slot 540.

Table Unit

Figure 23:
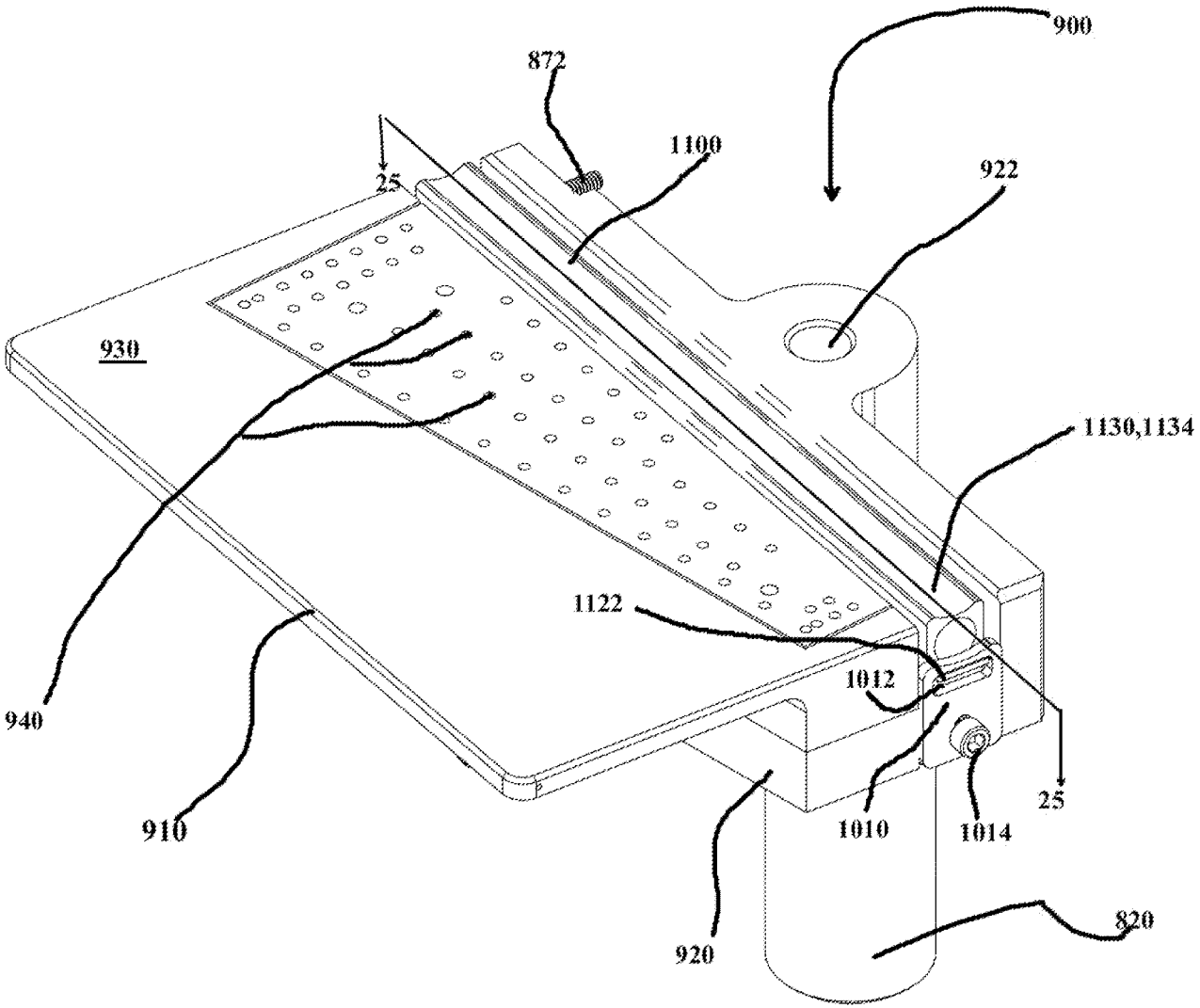
FIG. 23. Perspective of vacuum table with attached heater.
Figure 24A:
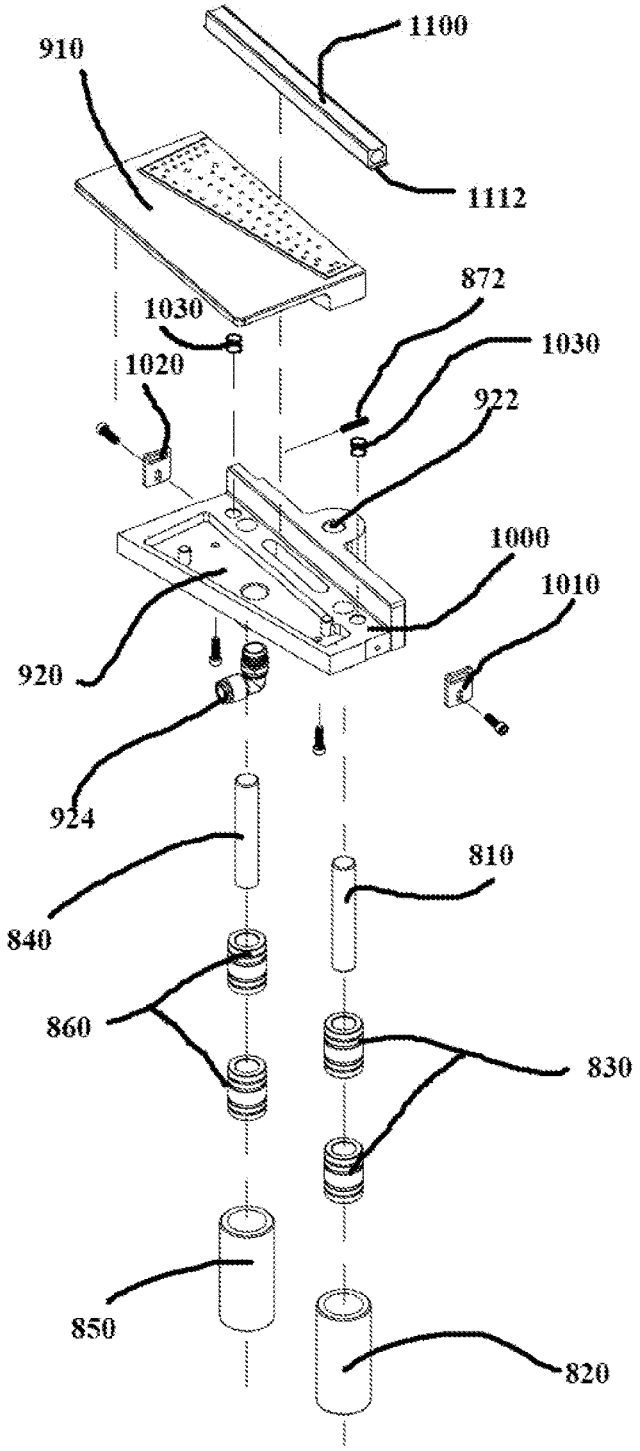
FIG. 24A. Exploded view of vacuum table with attached heater.
Figure 24B:
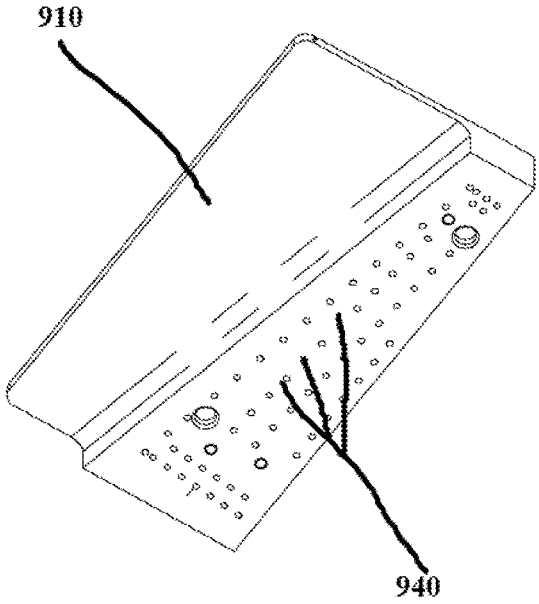
FIG. 24B. Perspective view of the upper portion of the vacuum table inverted from its position in FIG. 24A.
Figure 25:
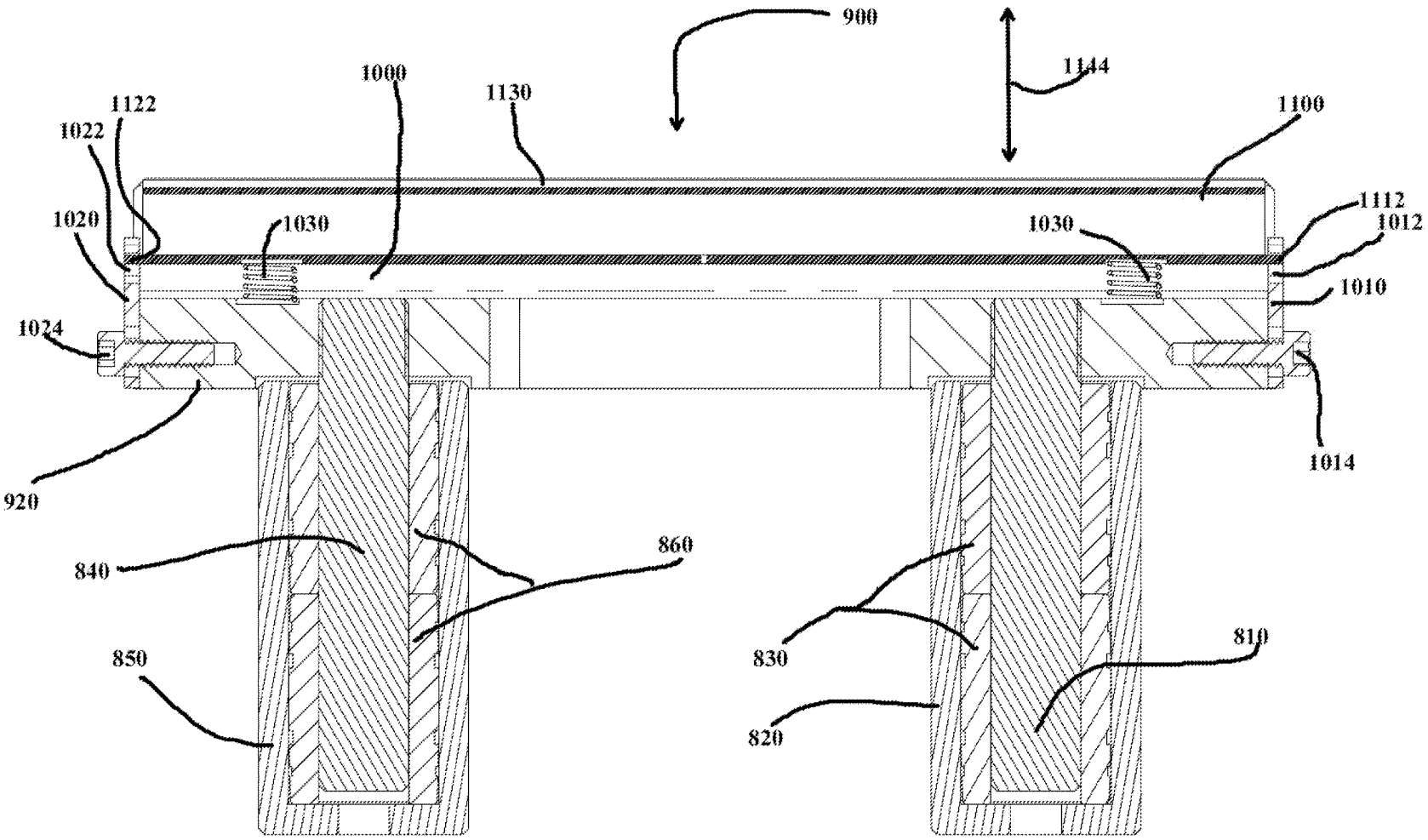
FIG. 25. Sectional view of vacuum table with attached heater taken along the lines 25-25 shown in FIG. 23.

FIG. 23 is a perspective of table unit 900 with heater 1100. FIG. 24A is an exploded view of table unit 900 with heater 1100. FIG. 24B is a perspective view of the upper portion of the table unit 900 inverted from its position in FIG. 24A. FIG. 25 is a sectional view of table unit 900 with heater 1100 taken along the lines 25-25 shown in FIG. 23.

Table unit 900 can include upper surface 930, upper portion 910, lower portion 920, table vacuum plenum 902, and vertical height sensor 870.

On upper surface 930 can be a plurality of vacuum openings 940. Inlet 924 can be fluidly connected to both vacuum plenum 902 and vacuum system 960 (not shown). In various embodiments vacuum system 960 can include a vacuum pump and be controlled by controller 100. In various embodiments the vacuum pump of vacuum system 960 can be the same vacuum pump as vacuum system 600.

Table unit 900 can be supported by first telescoping leg 810 and second telescoping leg 840. First telescoping leg 810 can be slidingly connected to support 820 via bearings 830. Second telescoping leg 840 can be slidingly connected to support 850 via bearings 860.

Vertical control lifting section 1300 can be operably connected to table unit 900 controlling the vertical height of upper surface 930. Vertical control lifting section 1300 can include motor 1320 which is operably connected to threaded shaft 1310. Vertical control lifting section can be threadable connected to threaded shaft 1310 such that rotation of threaded shaft in a first direction causes upper surface 930 to be raised and rotation of threaded shaft in the opposite direction caused upper surface to be lowered. Sensor 872 can be used by method and apparatus to vertically position the upper surface 930 of table unit 900 at one or more specifically desires heights, such as first 980, second 982, and/or third 984 vertical heights. In various embodiments third vertical height 984 is higher than second vertical height 982, which second vertical height 982 is higher than first vertical height 980.

Table unit 900 can include a heater unit 1100 which can be operably connected to controller 100. Heater unit 1100 can supported by table unit 900 via a plurality of springs 1030 located in recess 1000. Heater unit 1100 can include first end 1110, second end 1120, and recessed area 1130 spanning between first and second ends, wherein recessed area 1130 can have a radius of curvature 1134. At first end can be prong 1112, and at second end can be prong 1122. Recess 1000 can be included in table unit 900 for positioning heater unit 1100. On opposite ends of recess 1000 can be retaining plates 1010 and 1020. Retaining plate 1010 can be attached to table 900 via fastener 1014 and include opening 1012 for receiving prong 1112 of heater unit 1100. Retaining plate 1020 can be attached to table unit 900 via fastener 1024 and include opening 1022 for receiving prong 1122 of heater unit 1100.

Openings 1012 and 1022 can be larger in the vertical direction than the heights of prongs 1112 and 1122 of heater unit 1100 so that heater unit 1100 can have a limited amount of vertical motion (schematically indicated by arrows 1144 in FIG. 25). Plurality of springs 1030 can bias heater unit 1100 in the vertical direction so that prongs 1112 and 1122 are normally respectively in contact with the upper portions of openings 1012 and 1022. Springs 1030 can include spring constants such that a desired amount of upward reaction force is placed by heating unit 1100 squeezing against conical form mandrel 500 when upper surface 930 of table is in the third vertical position 984.

Caddy or Garage Unit

Figure 17:
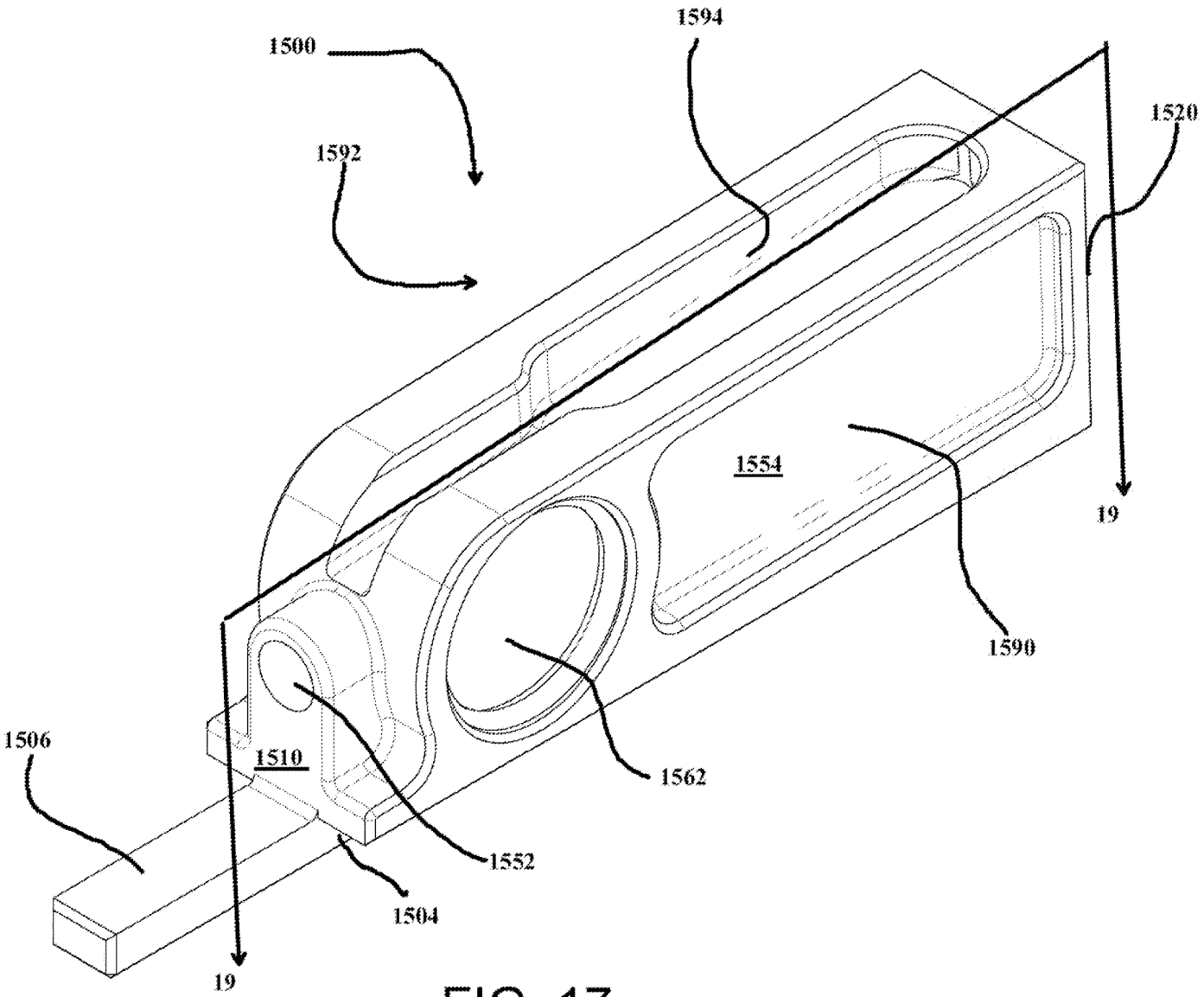
FIG. 17. Perspective of manual garage cone remover sliding piece.
Figure 18:
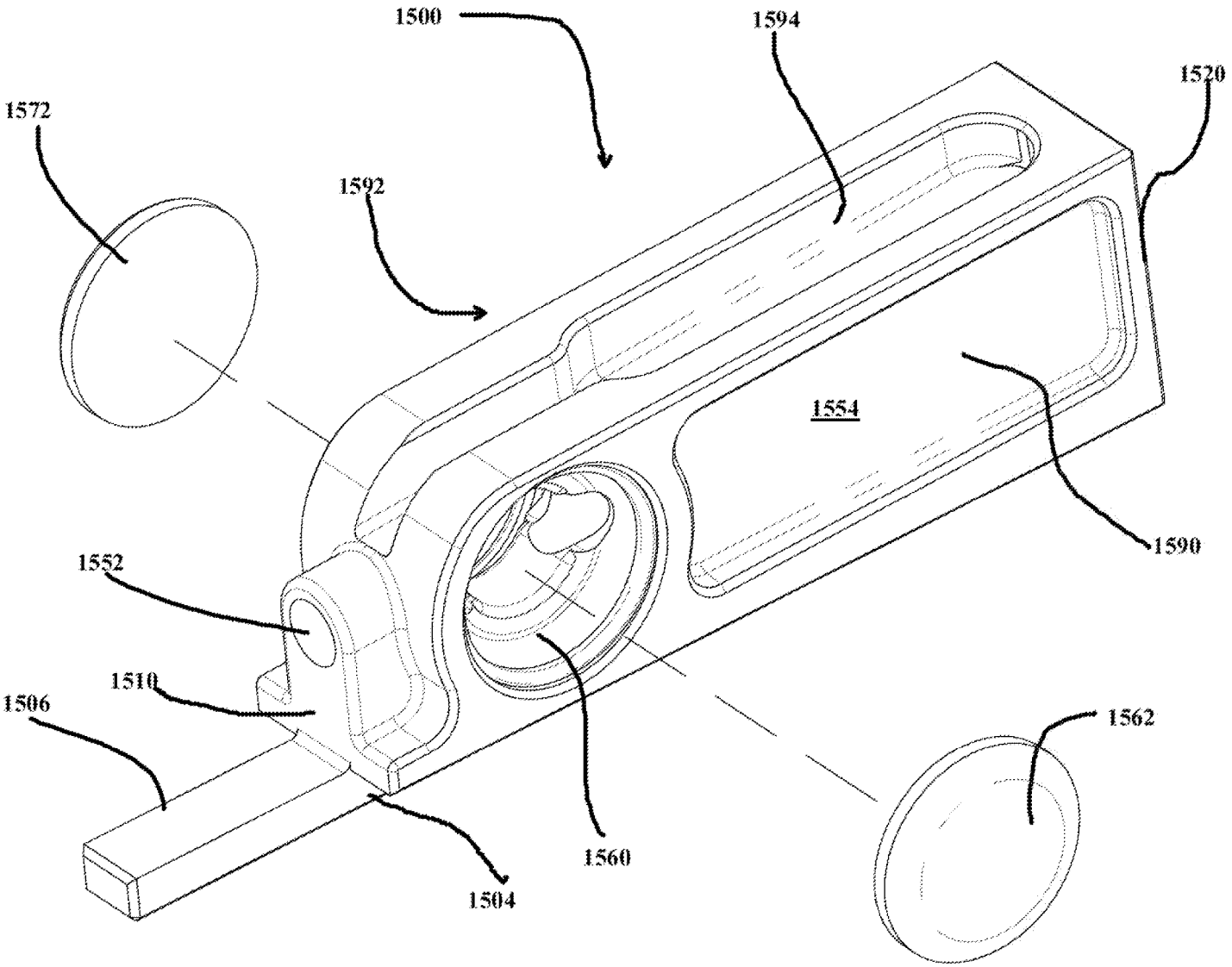
FIG. 18. Exploded view of clear movable sliding piece.
Figure 19:
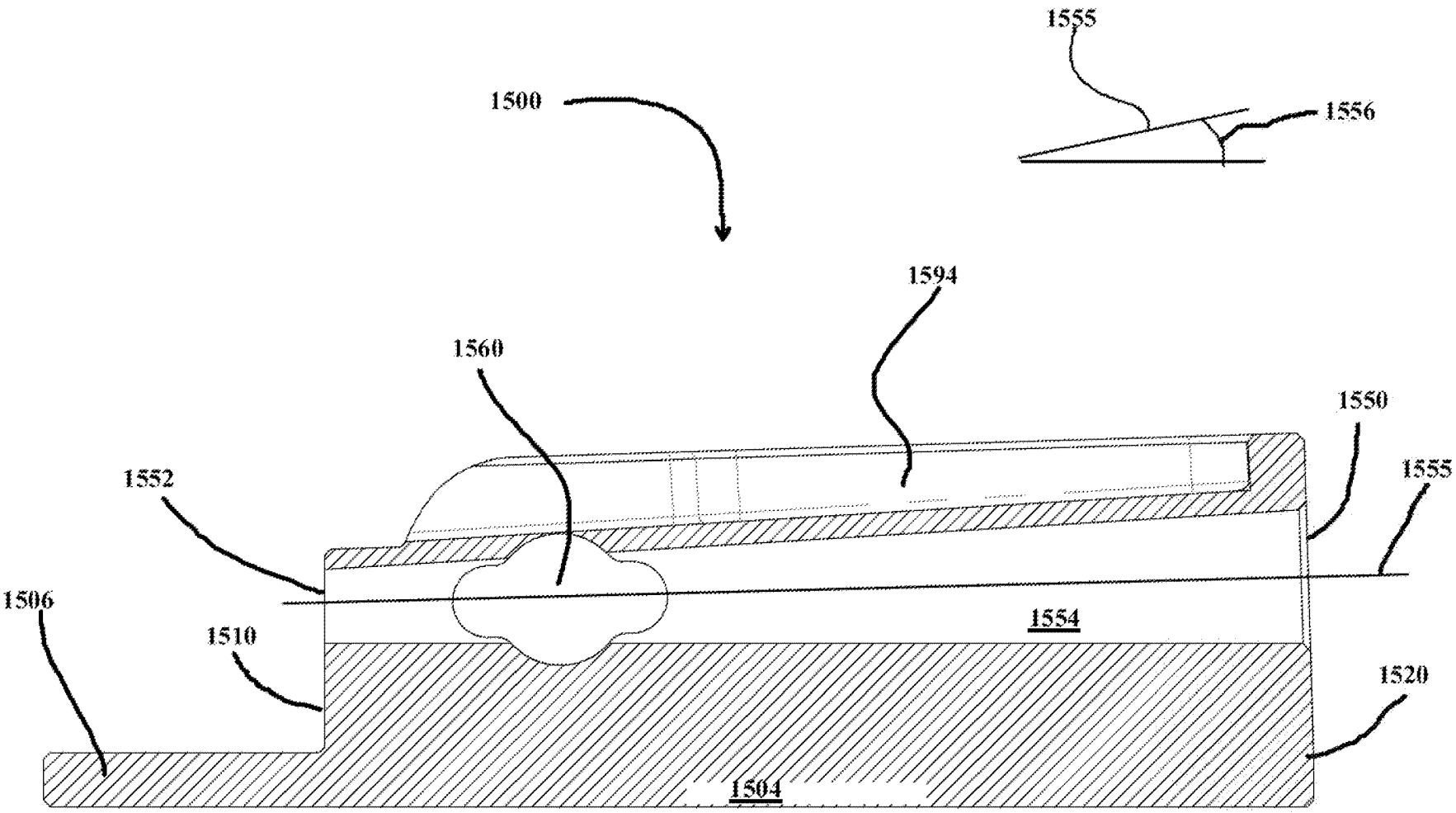
FIG. 19. Sectional view of clear movable sliding piece taken along the lines 19-19 shown in FIG. 17.

FIG. 17 is a perspective of caddy unit or garage carriage 1500 sliding piece. Figure is an exploded view of clear movable/slidable caddy unit or garage carriage 1500 sliding piece. FIG. 19 is a sectional view of clear movable/slidable caddy unit or garage carriage 1500 sliding piece taken along the lines 19-19 shown in FIG. 17.

Caddy unit or garage carriage 1500 can include first end 1510, second end 1520, with an open tapered interior 1554 spanning from first end 1510 to second end 1520, and a guiding base 1504 spanning from first end 1510 to second end 1520, with the portion of guiding base 1504 extending past second end 1520 being called the extension base 1506. At first end 1510 is a small opening 1552 to open tapered interior 1554, and at second end 1520 is a larger opening 1550 to open tapered interior 1554.

Between first and second ends 1510, 1520 can be first and second openings 1560, 1570. In first opening 1560 can be placed a flexible gripper 1562, and in second opening 1570 can be placed a flexible gripper 1572. Flexible grippers 1562 and 1572 can be comprised of a flexible material such as rubber, plastic or teflon. In various embodiments flexible grippers 1562, 1572 can be circular or dislike in construction.

Caddy unit or garage carriage 1500 can preferably be comprised of a translucent material or clear material so that the portion of conical shell 2000 located in the open tapered interior 1554 can be seen by a user from outside or exterior of caddy unit or garage carriage 1500. In various embodiments, caddy unit or garage carriage 1500 can include window 1590, window 1592, and window 1594 which window units can allow a user to view the portion of conical shell 2000 located inside interior 1554 and immediately adjacent the particular window. In various embodiments the body of caddy unit or garage carriage 1500 can be translucent enough to allow a user to see conical shell 2000 when located inside interior 1554 when looking through the body but not through a window. In various embodiments the body of caddy unit or garage carriage 1500 can be translucent enough to allow a user, looking through one of the windows 1590, 1592, and/or 1592, to see the portion of conical shell 2000 immediately adjacent the window being looked through. In various embodiments the body of caddy unit or garage carriage 1500 can be comprised of plastic, such as clear plastic (or comprised of glass). In various embodiments one or more of window 1590, window 1592, and/or window 1594 are closed. In other embodiments one or more of window 1590, window 1592, and window 1594 can be open.

Caddy unit or garage carriage 1500 can be slidably supported by base 1600. Base 1600 can include first end 1610, second end 1620, and slot/recessed area 1630 which spans between first and second ends 1610, 1620. At first end 1610 can be located stopper plate 1640, which stopper plate can include opening 1644 for allowing extension portion 1506 of guiding base 1504 to extend past first end 1610 of base 1600.

In various embodiments tapered interior 1554 can have a longitudinal axis 1555 which is angled upwardly relative to a horizontal plane (schematically indicated by angle 1556 in FIG. 19) such that the bottom of tapered interior 1554 is horizontal, and would be substantially parallel to the bottom of exterior taper 570 of conical form mandrel 500. In this manner tapered interior 1554 can substantially align with conical shell 2000 wrapped about conical form mandrel 500. In various embodiments angle 1556 can be at least ½, 1, 1.5, 2, 3, 4, 5, 6, 7, 8, 9, and/or 10 degrees. In various embodiments angle 1556 can fall within a range of between any two of the above referenced minimum angular amounts for angle 1556. In various embodiments angle 1556 can match angle 502 but in the opposite direction regarding the horizontal plane (e.g., angle 502 is downwardly located and angle 1556 is upwardly located relative to the horizontal plane).

Methods of Constructing a Conical Shell

In one embodiment is provided a conical form mandrel 500 having an exterior surface 550, an interior section 504, and a vacuum opening 530 fluidly connecting the interior section 504 with the exterior surface 550; a motor 310 operably connected to the conical form mandrel 500 which can rotate the conical form mandrel 500; a conical form mandrel vacuum system 600 operably connected to the interior section 504 of the conical form mandrel 500; a vacuum table 900 having an upper surface 930, a vertical elevation system 1300 operably connected to the upper surface 930, which vertical elevation system 1300 vertically positions the upper surface 930, and table heater 1100 supported by the vacuum table 900, and a table vacuum system 960 fluidly connected to the upper surface 930; a garage system 1490 located next to the conical form mandrel 500, the garage system 1490 including a base 1600 and a caddy unit or garage carriage 1500 slidingly connected to the base 1600, the garage carriage 1500 including first 1510 and second 1520 ends with an internal opening 1550 extending from the first 1510 to the second 1520 end, an a squeeze lock 1559 (comprising of flexible grippers 1562 and 1572) connected to the garage carriage 1500.

Figure 2A:
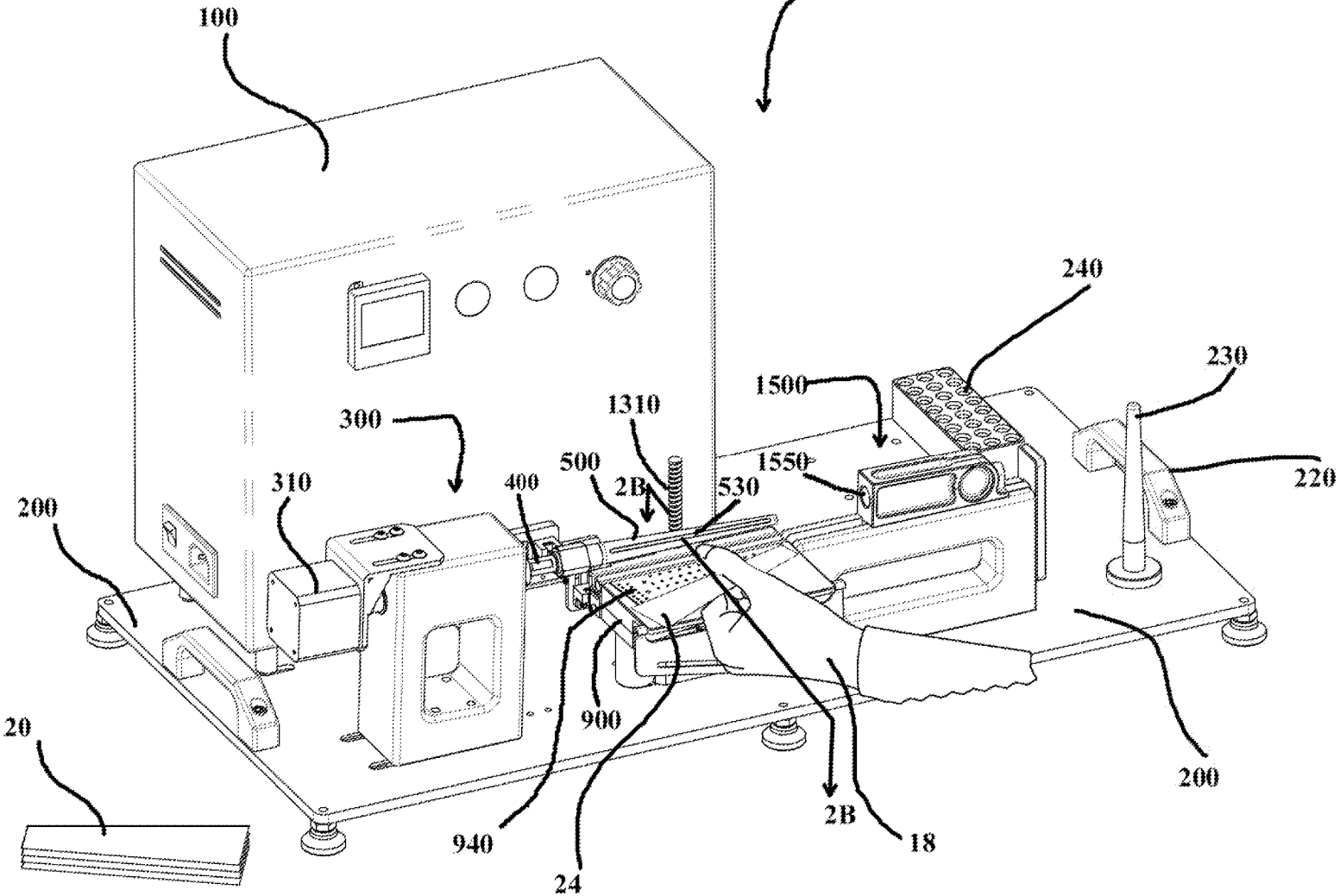
FIG. 2A. Perspective view schematically indicating user picking sheet of smokable material from stack of pre-cut sheets of smokable materials and placing that sheet on vacuum table where the vacuum table is located at a first vertical position.
Figure 2B:
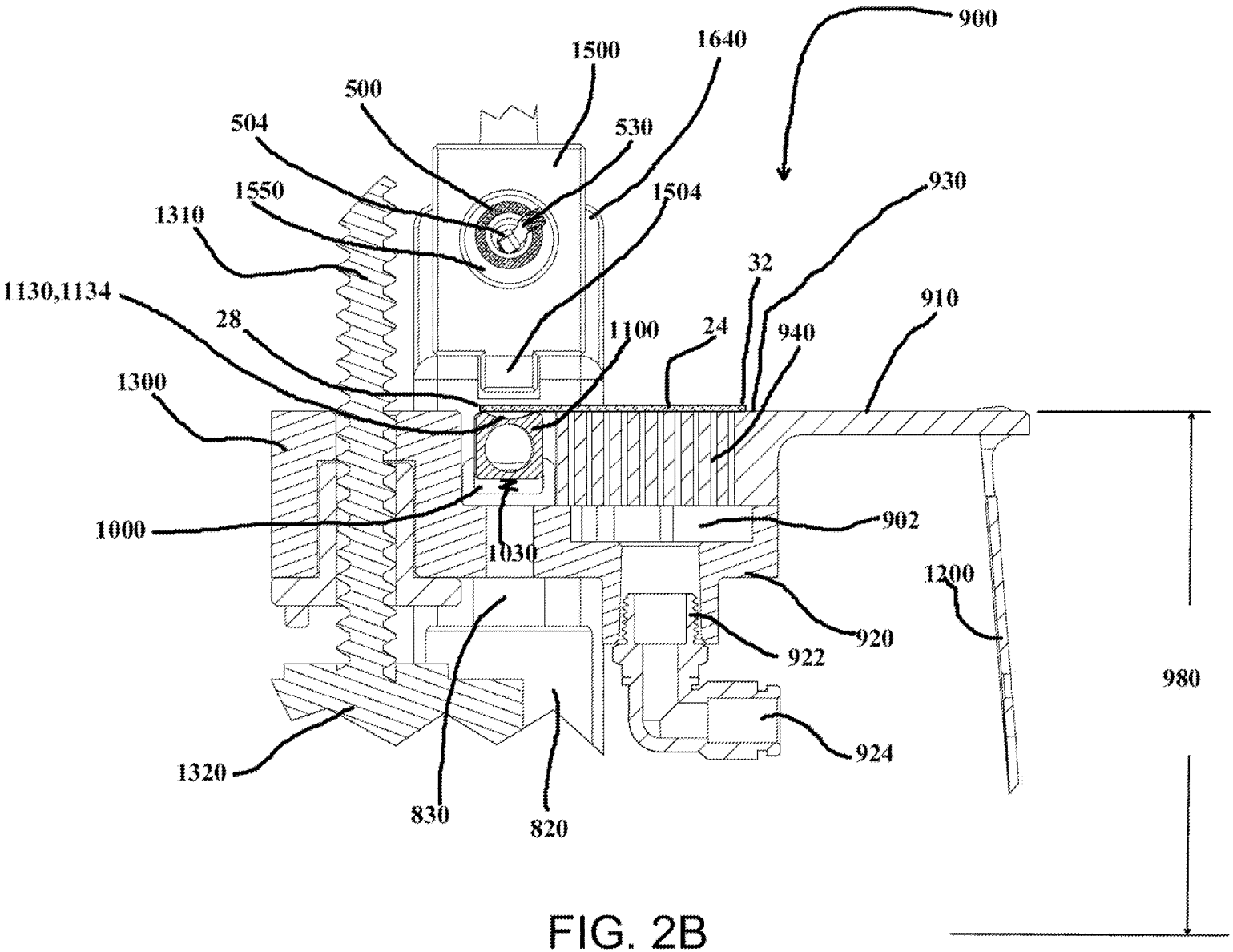
FIG. 2B. Sectional view taken through lines 2B-2B of FIG. 2A showing the smokable sheet over the vacuum table and the heater, where the vacuum table is located in the first vertical position.

FIG. 2A is a perspective view schematically indicating user selecting a sheet 24 of smokable material from stack 20 of pre-cut sheets of smokable materials and placing that sheet 24 on vacuum table 900 where the upper surface 930 of the vacuum table 900 is located at a first vertical position 980. FIG. 2B is a sectional view taken through lines 2B-2B of FIG. 2A showing the smokable sheet 24 over the vacuum table 900 and the heater 1100, where the upper surface 930 of the vacuum table 900 is located at the first vertical position 980. When placing sheet 24 on upper surface 930 is it preferred controller 100 is not causing vacuum system 960 to pull a vacuum through plurality of vacuum openings 940 on upper surface 930 as this allows the user to freely position sheet 24 relative to upper surface 930. Also upper surface 930 being at first vertical position 980 provides a sufficient gap between upper surface 930 and the bottom of conical form mandrel 500 so that the user can freely position sheet 24 on upper surface 930 and below conical form mandrel 500 (FIG. 2B shows sheet 24 positioned on upper surface 930, below conical form mandrel 500, and extending over heater unit 1100 with edge 28 being substantially aligned with the left most edge of heater unit 1100). Preferably, when sheet 24 is positioned by the user, sheet 24 will cover all of the plurality of vacuum openings 940 (to prevent a vacuum leak in future steps). In various embodiments upper surface 930 of vacuum table 900 can have visual location indicator(s) to assist the user in positioning sheet 24 on upper surface 930. In various embodiments milled grooves can be placed on upper surface 930 of vacuum table 900 which milled grooves correspond to the placement of one or more edges of sheet 24.

Figure 3:
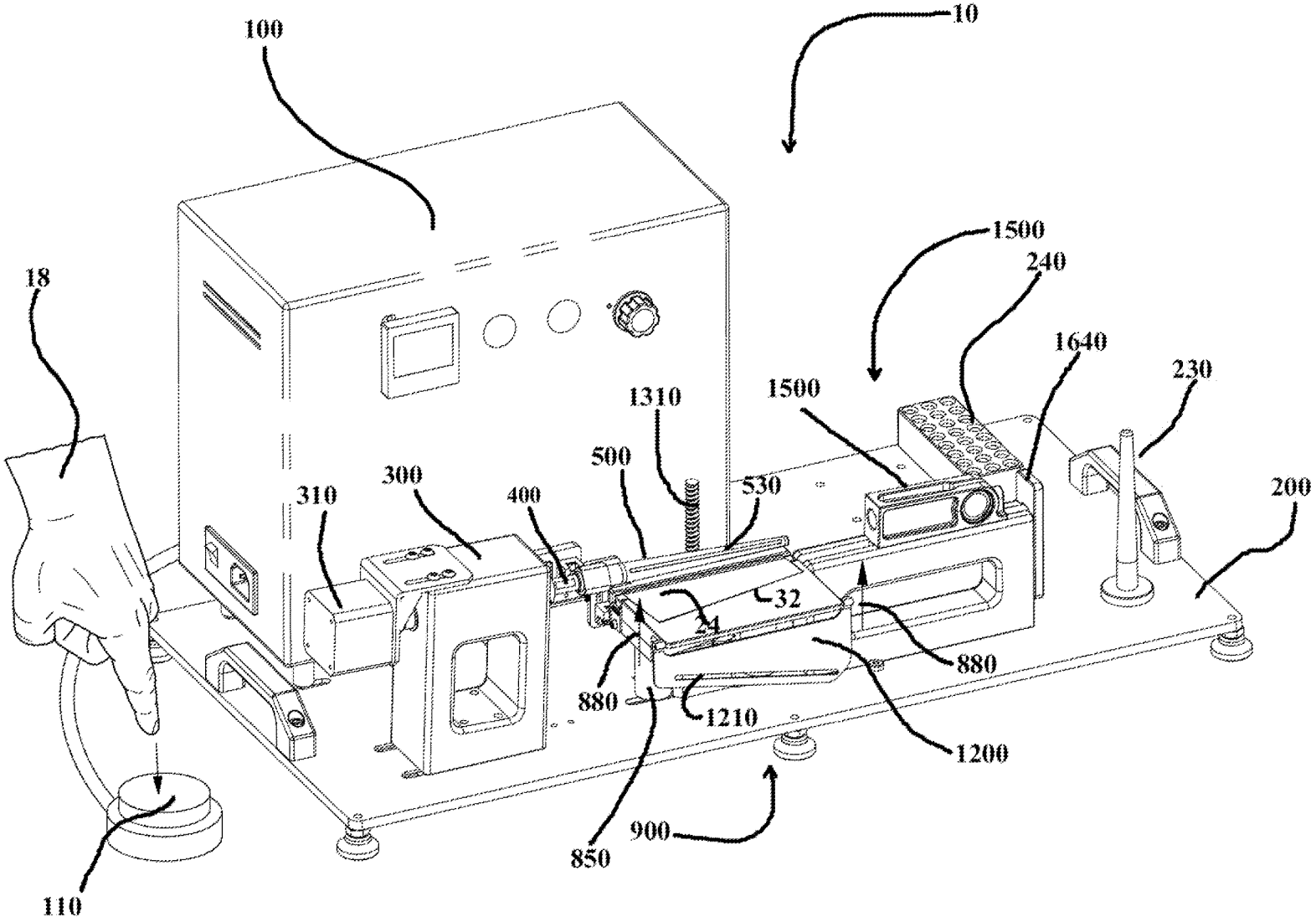
FIG. 3. Perspective view schematically indicating user starting the system and method along with schematically indicating the shield being placed over the sheet of smokable material, and the vacuum table moving from first vertical position upwardly to a second vertical position.

FIG. 3 is a perspective view schematically indicating, with sheet 24 being positioned in FIGS. 2A and 2B, a user starting the system 10 and method along with schematically indicating the shield/retaining plate 1200 being placed over the sheet 24 of smokable material, and the upper surface 930 of the vacuum table 900 moving from first vertical position 980 upwardly to a second vertical position 982. System 10 can be started by pushing on start button 110. After pressing start button 110 upper surface 930 of table 900 can moved vertically upward (schematically indicated by arrow 880) from first vertical position 980 to second vertical position 982. Controller 100 controls motor 1320 of vertical control lifting section 1300 such that threaded shaft 1310 is rotated, wherein because threaded shaft is threadably connected to upper surface 930 of table 900 causing vertical movement of upper surface 930. When moving upward in the direction of arrow 880, it is preferred that controller 100 causes vacuum system 960 to pull a partial vacuum through plurality of vacuum openings 940 on upper surface 930 to prevent relative movement between sheet 24 and upper surface 930 keeping sheet 24 in the position that the user had earlier placed sheet 24. In various embodiments vacuum system is turned on prior to vertical movement from movement between first vertical position 980 to second vertical position 982.

Figure 4:
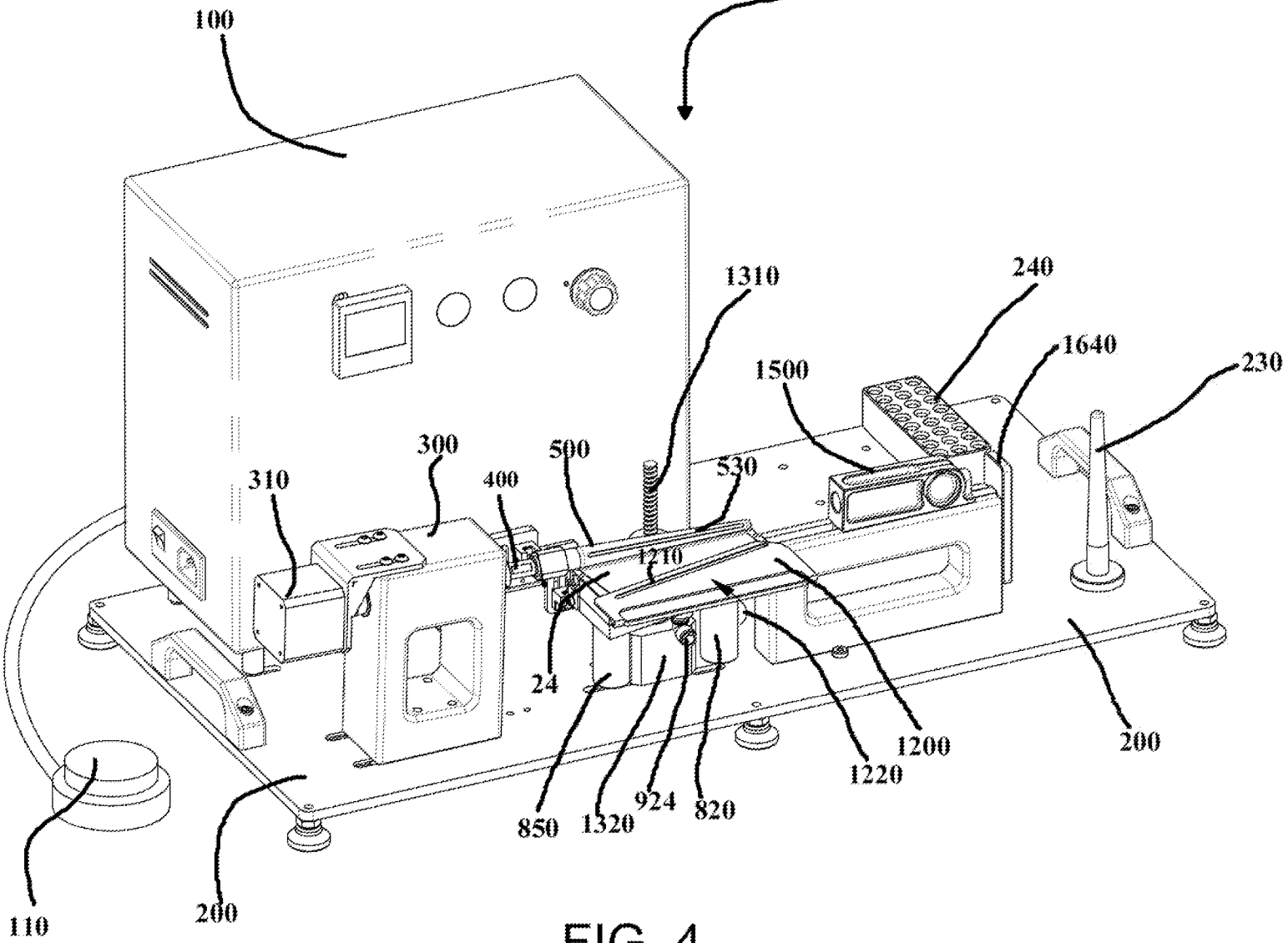
FIG. 4. Perspective view schematically showing shield now placed on top of the sheet of smokable material.

FIG. 4 is a perspective view schematically showing shield/guide 1200 now placed on top of the sheet 24 of smokable material. It is preferred that the guide/shield 1200 be placed by the user over sheet 24 after button 110 is pushed by the user to cause controller 100 to start controlling table 900 and/or conical form mandrel 500. However, in one embodiment shield guide/shield 1200 can be placed over sheet 24 before button 110 is pushed by the user to cause controller 100 to start.

Figure 5:
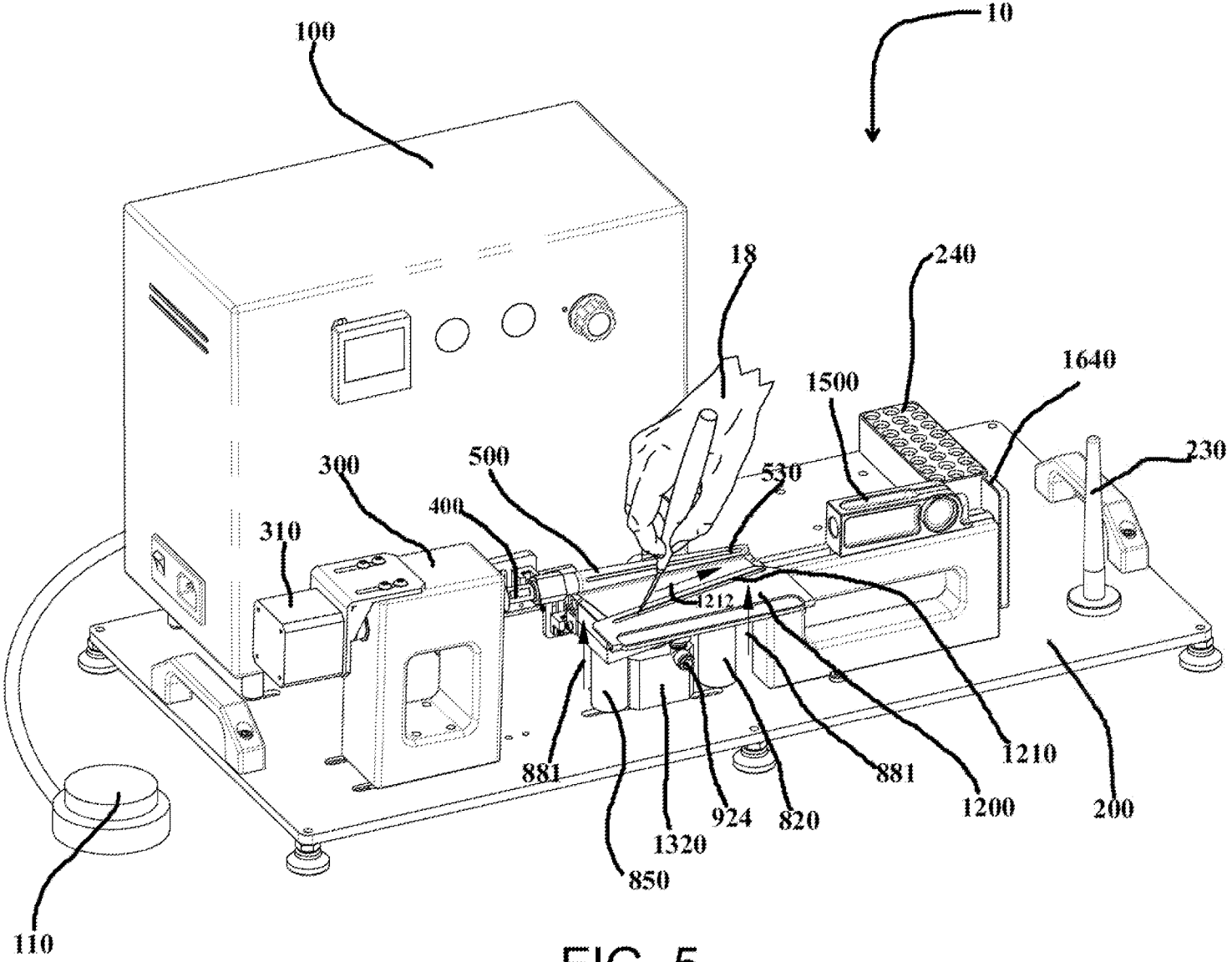
FIG. 5. Perspective view schematically showing operator using a brush to apply activator to activate glue already on smokable sheet (through slot in plate), along with vacuum table having moved vertically upward to a third vertical position.

FIG. 5 is a perspective view schematically showing operator using a brush to apply activator (schematically indicated by arrow 1212) to activate glue (glue line 36) already on smokable sheet 24 (through slot 1210 in plate/guide 1200), along with upper surface 930 of vacuum table 900 having moved vertically upward (schematically indicated by arrow 881) to a third vertical position 984. Slot 1210 directs the liquid over the glue line of sheet 24. In various embodiments the liquid activator applied can comprise water, or a mixture of ethanol and water (e.g., 50/50 percent by weight mixture). It is preferred that the activator is applied during the time period between upper surface 930 moves from the first vertical height 980 to second vertical height 982 which can reduce the overall time of creating conical shell 2000.

Figure 6A:
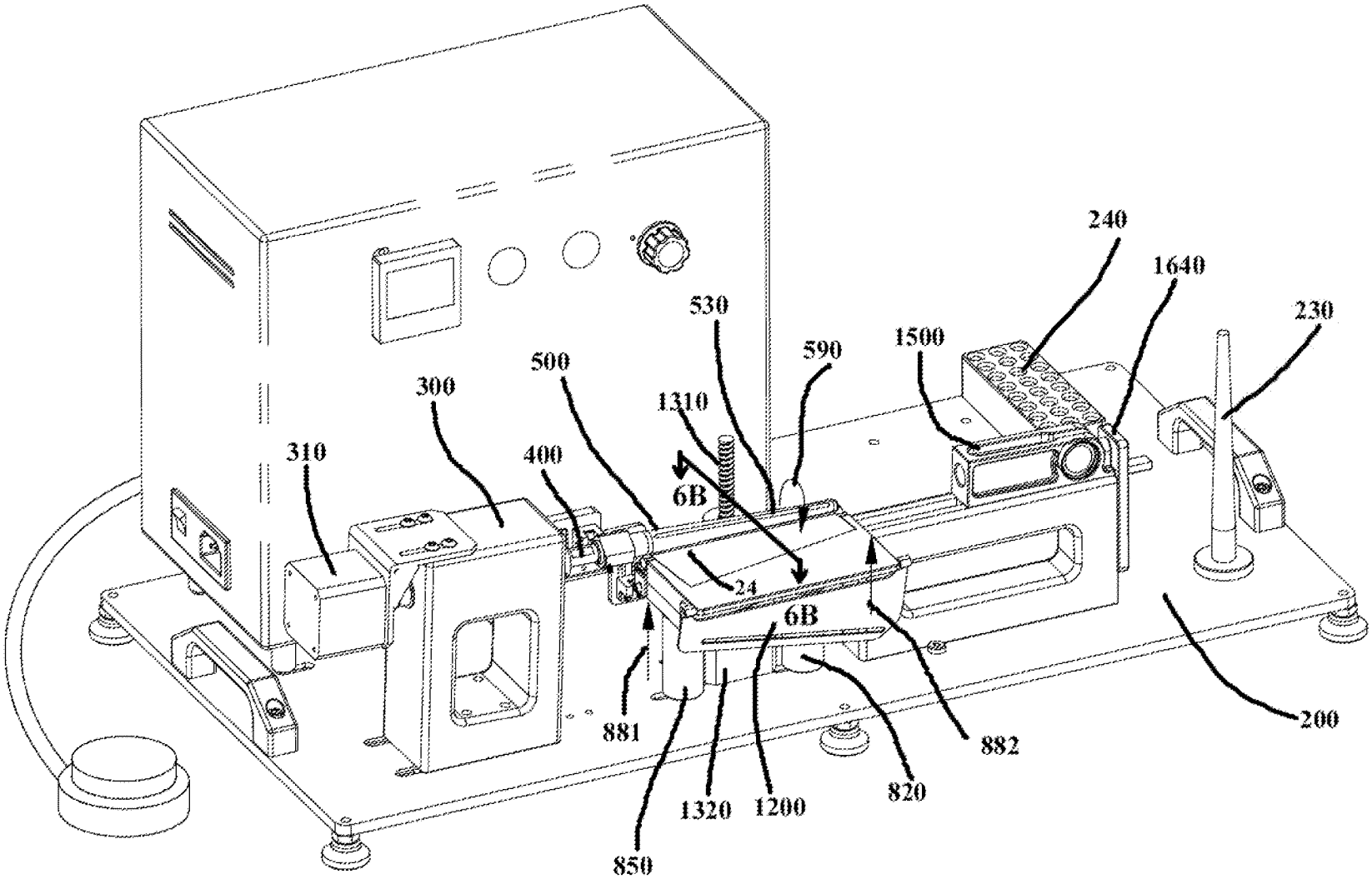
FIG. 6A. Perspective view schematically showing the conical form mandrel starting to rotate and the shield being removed from being on top of the smokable sheet.
Figure 6B:
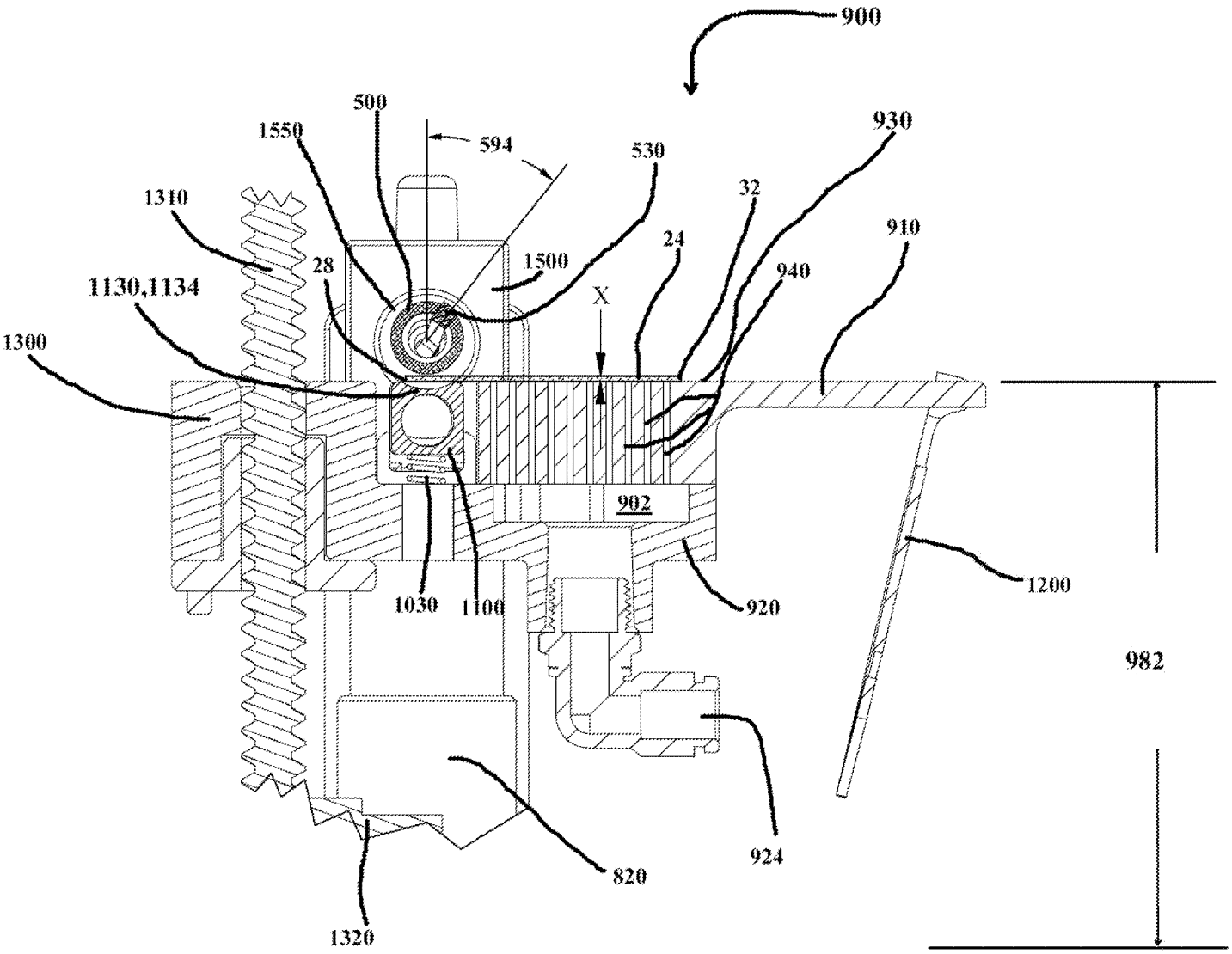
FIG. 6B. Sectional view taken through lines 6B-6B of FIG. 6A showing the smokable sheet over the vacuum table and the heater, where the vacuum table is located in the third vertical position, and the conical form mandrel is in its home position before the start of A rotation cycle.

FIG. 6A is a perspective view schematically the conical form mandrel 500 starting to rotate (schematically indicated by arrow 590) and the shield/guide 1200 being removed (schematically indicated by arrow 882) from being on top of the smokable sheet 24 to being away from smokable sheet 24. In FIG. 6A upper surface 930 can be located at second vertical height 982 and rotation in the direction of arrow 590 causes vacuum slot 530 of conical form mandrel 500 to move from its home position (schematically shown in FIGS. 1 through 6B) to its bottom dead center position (schematically shown in FIG. 7C). FIG. 6B is a sectional view taken through lines 6B-6B of FIG. 6A showing the smokable sheet 24 over upper surface 930 of vacuum table 900 and the heater 1100, where upper surface 930 of vacuum table 900 is located in the third vertical position 984, and the conical form mandrel 500 is in its home position before the start of a rotation cycle. FIG. 7A is a perspective view schematically showing the conical form mandrel 500 now having rotated to a position where the vacuum slot 530 is closely spaced to the smokable sheet 24. During this time between FIGS. 6A, 6B, and 7B, sheet 24 can be held in position on upper surface 930 of table 900 by vacuum being pulled through plurality of vacuum openings 940 (schematically indicated by arrows 941).

Figure 7B:
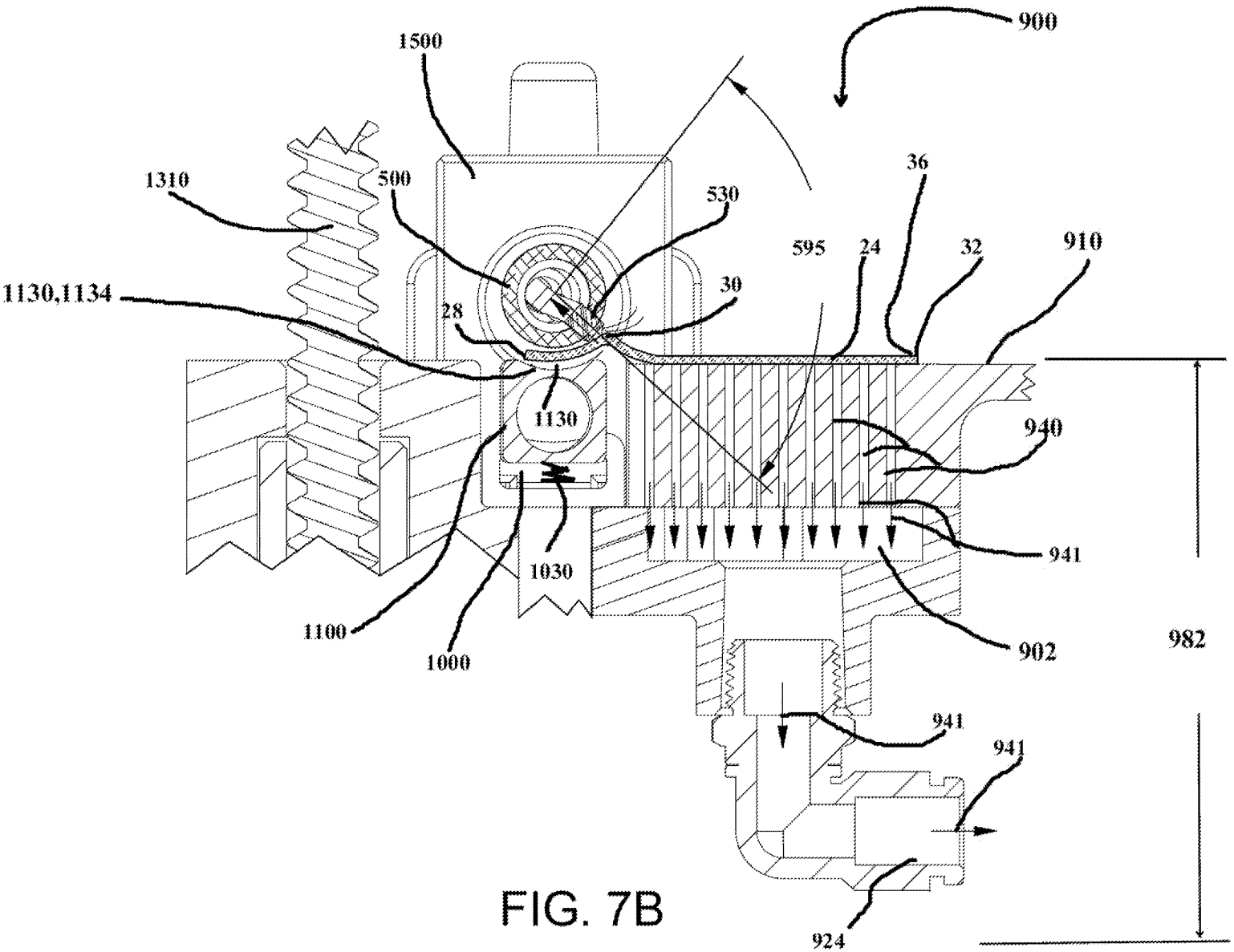
FIG. 7B. Sectional view taken through lines 7B-7B of FIG. 7A schematically indicating the conical form mandrel is rotating and the smokable sheet being partially raised from the vacuum table by the vacuum from the vacuum slot.

FIG. 7B is a sectional view taken through lines 7B-7B of FIG. 7A schematically indicating the conical form mandrel 500 is rotating and the smokable sheet 24 being partially raised from the upper surface 930 of the vacuum table 900 by the vacuum from the vacuum slot 530 of conical form mandrel 500. It is preferred that the strength of vacuum through vacuum slot 530 is less than the strength of vacuum through plurality of openings 940 so that sheet 24 can be maintained in position on upper surface 930 of table 900 at least until conical form mandrel rotates to the position shown in FIG. 7C (or bottom dead center position for vacuum slot 530). The partial lifting of sheet 24 at point 30 as indicated in FIG. 7B along with vacuum being pulled through openings 940 tends to put sheet 24 in tensions and flatten out sheet 24 when conical form mandrel 500 reaches the rotational position (vacuum slot 530 being at bottom dead center) shown in FIG. 7C.

Figure 7C:
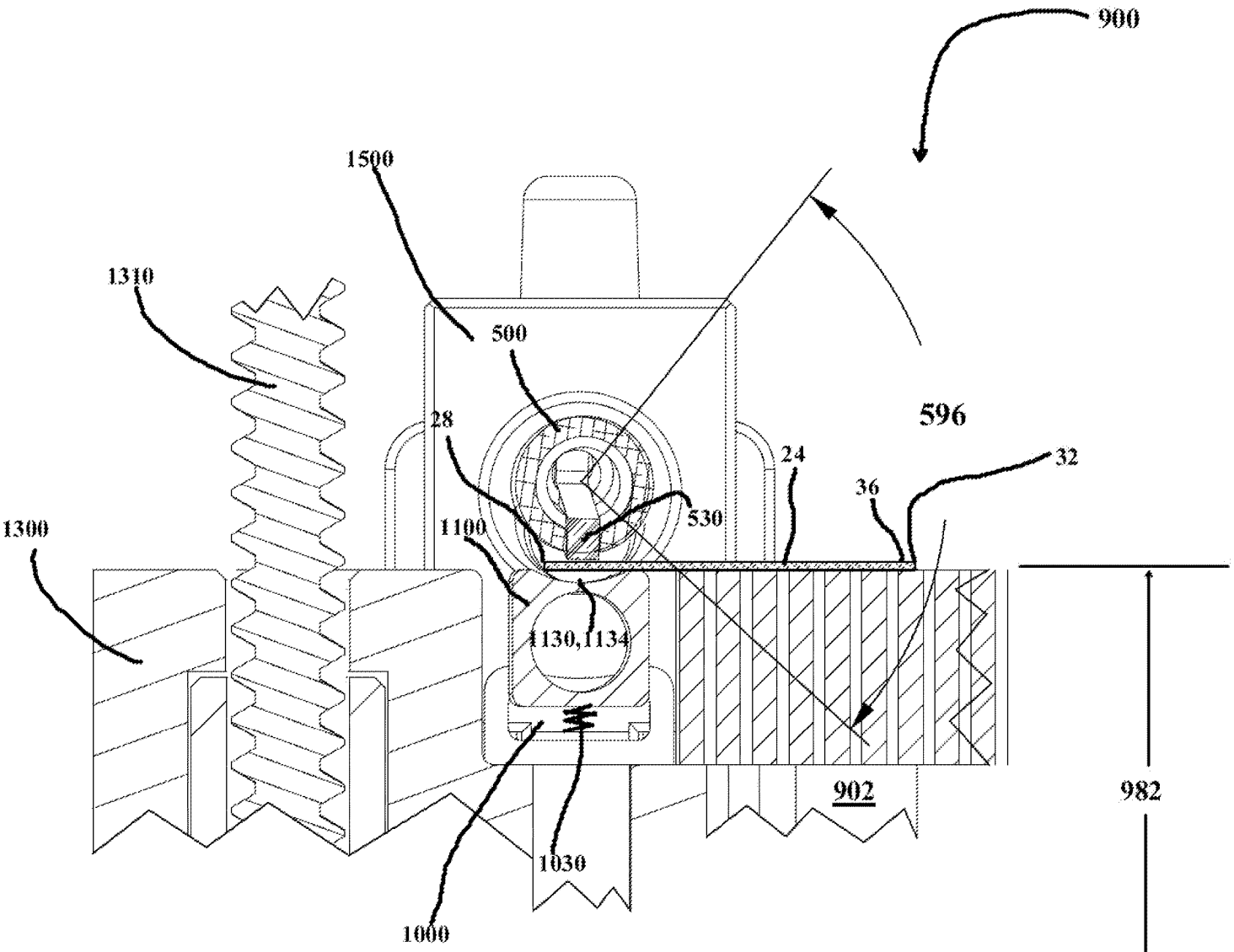
FIG. 7C. Sectional view taken through lines 7B-7B of FIG. 7A schematically showing the conical form mandrel having now rotated to a position where the vacuum slot is positioned at bottom dead center or pointing vertically downward and with the smokable sheet being held on the vacuum table by the vacuum. After this point the vacuum on the vacuum table is cut off.

FIG. 7C is a sectional view taken through lines 7B-7B of FIG. 7A schematically showing the conical form mandrel 500 having now rotated to a position where the vacuum slot 530 is positioned at bottom dead center or pointing vertically downward and with the smokable sheet 24 being held on the vacuum table by the vacuum being pulled through plurality of openings 940 on upper surface 930 of vacuum table 900. After this point the vacuum being pulled through plurality of openings 940 on upper surface 930 of vacuum table 900 can be cut off. Preferably, the vacuum being pulled through vacuum slot 530 remains on. Also preferably, controller 100 causes rotation of conical form mandrel 500 is stop with vacuum slot remaining in the bottom dead center position. After this point controller 100 can cause upper surface 930 of table 900 to move vertically upward from second vertical height 982 to third vertical height shown in FIG. 7D.

Figure 7D:
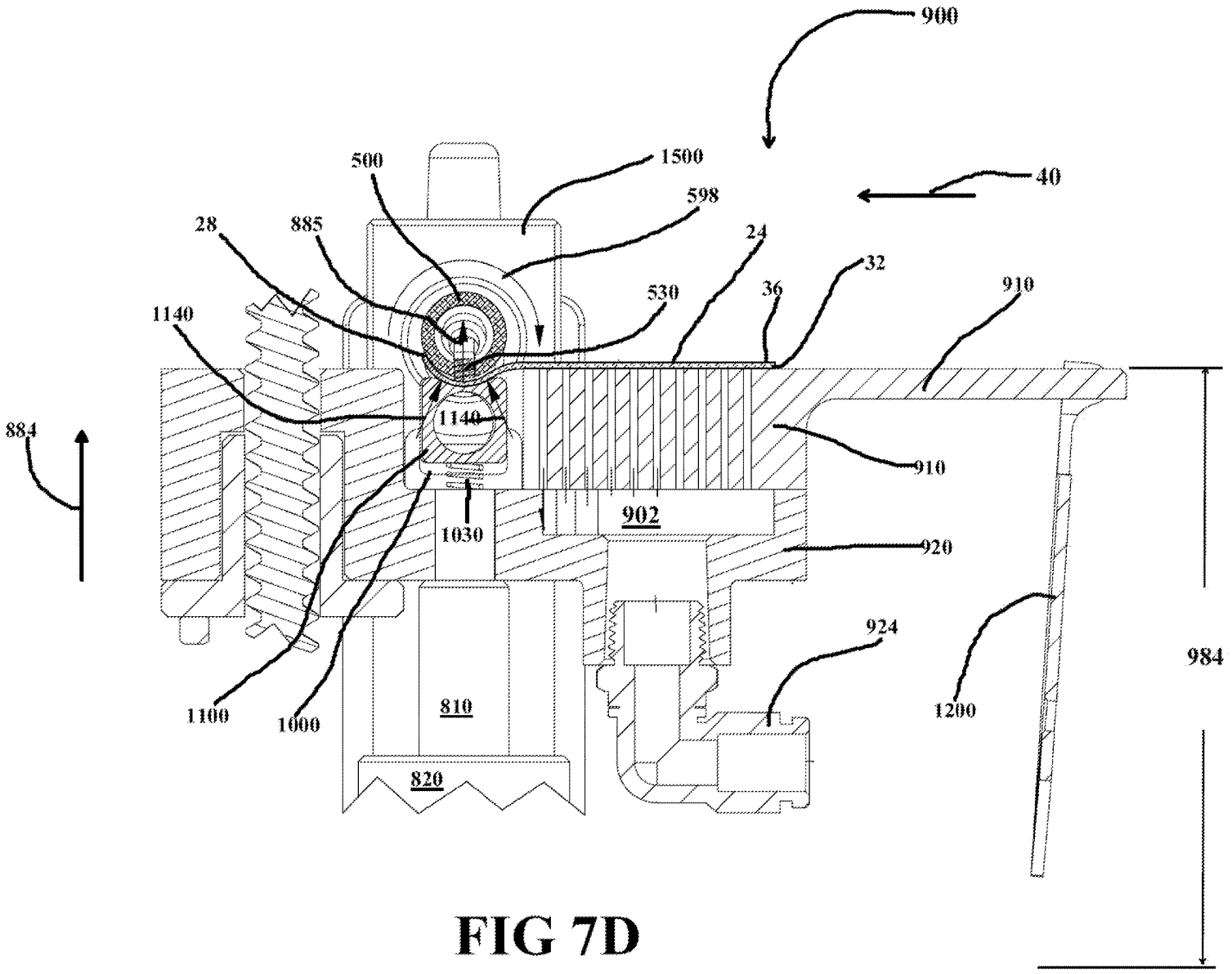
FIG. 7D. Sectional view taken through lines 7B-7B of FIG. 7A schematically showing the vacuum table now having moved up to the third vertical position and further showing the conical form mandrel continuing to rotate from the position where the vacuum slot is positioned at bottom dead center or pointing vertically downward and with the smokable sheet being held on the vacuum table by the vacuum.
Figure 7E:
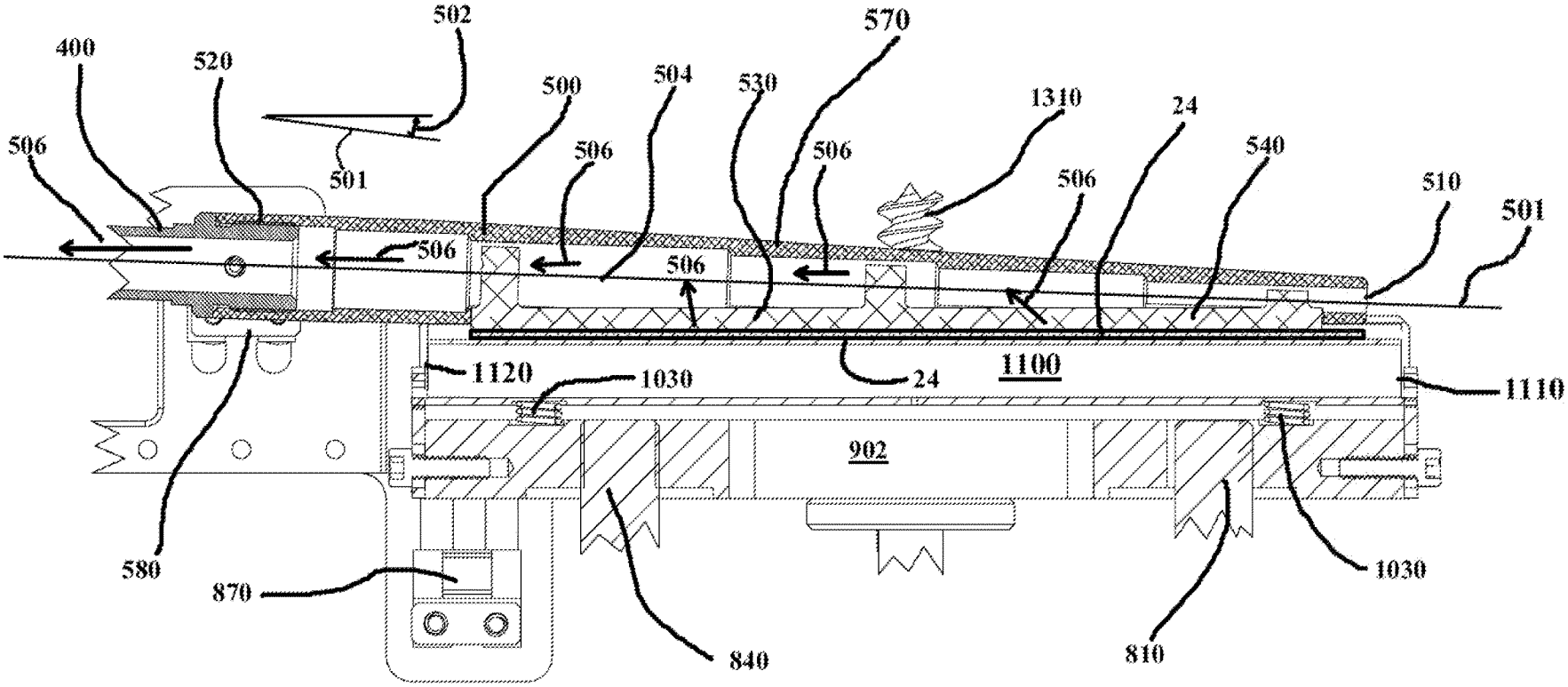
FIG. 7E. Sectional view taken along the longitudinal axis of the conical form mandrel and schematically showing a vacuum being pulled from the vacuum slot which is still positioned at bottom dead center or pointing vertically downward holding the smokable sheet to the conical form mandrel.

FIG. 7D is a sectional view taken through lines 7B-7B of FIG. 7A schematically showing the upper surface 930 of vacuum table 900 now having moved up to the third vertical position 984 and now squeezing sheet 24 (schematically indicated by arrows 1140) between heater unit 1100 (pushed up by springs 1030) and the bottom of conical form mandrel 500. FIG. 7E is a sectional view taken along the longitudinal axis of the conical form mandrel 500 and schematically showing (by plurality of arrows 506) a vacuum being pulled from the vacuum slot 530 which is still positioned at bottom dead center or pointing vertically downward holding the smokable sheet 24 to the exterior surface 550 of the conical form mandrel 500. In one embodiment the vacuum being pulled through plurality of openings 940 is cut off prior to the time upper surface 930 of table 900 reaches third vertical height 984. In other embodiments the vacuum being pulled through plurality of openings 940 is cut off only after the time upper surface 930 of table 900 reaches third vertical height 984. In one embodiment, after upper surface 930 reaches third vertical height, controller 100 causes conical form mandrel 500 to continue rotation (schematically indicated by arrow 598), wherein because vacuum is being pulled through vacuum slot 530, causes sheet 24 to become attached to conical form mandrel and sheet 24 to move relative to upper surface 930 in the direction of arrow 40.

The remaining rolling process will have conical form mandrel rotating in the direction of arrow 598 while controller 100 causes vacuum being pulled through vacuum slot 530 and sheet 24 being squeezed between heater unit 1100 and conical form mandrel 500. In this way tension can be maintained in sheet 24 during the rolling process.

Figure 8A:
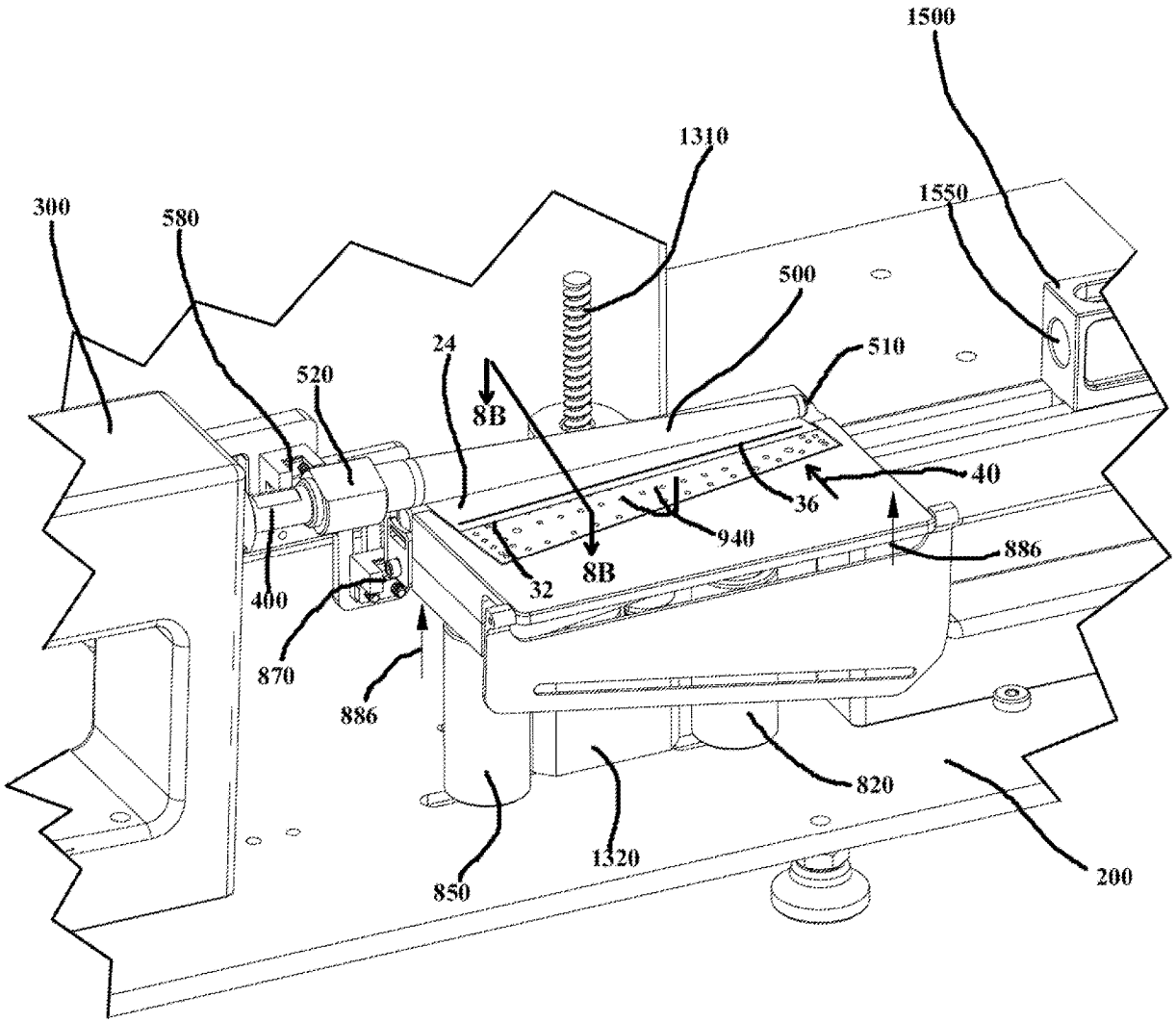
FIG. 8A. Perspective view schematically showing the conical form mandrel now having continued to rotate past the bottom dead center position, and showing that the smokable sheet is now partially slid across the vacuum table revealing vacuum openings on the vacuum table.
Figure 8B:
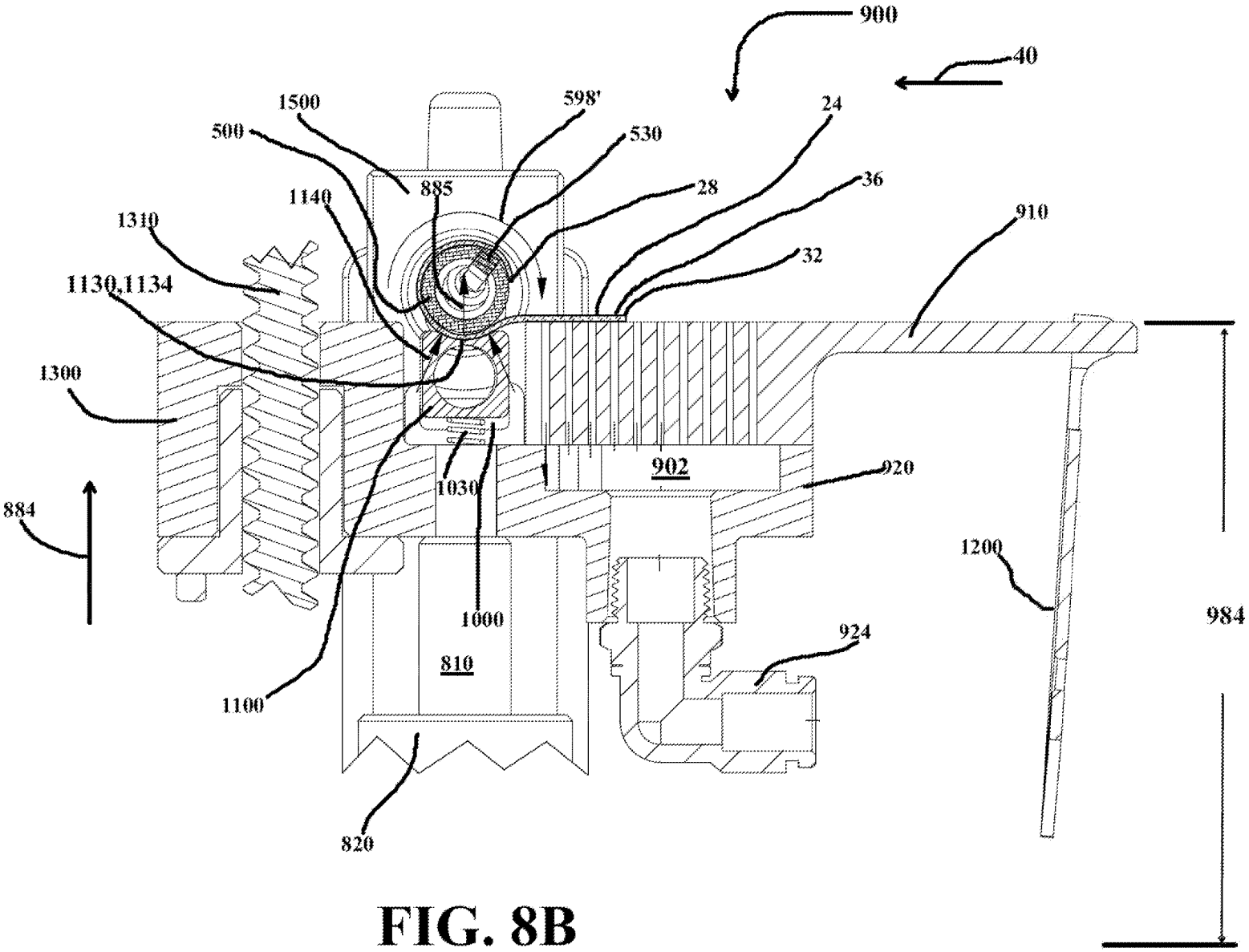
FIG. 8B. Sectional view taken through lines 8B-8B of FIG. 8A schematically indicating, while the vacuum table remains at the third vertical position, the conical form mandrel, with vacuum being pulled through the vacuum slot, is rotating and pulling the smokable sheet from the vacuum table while tension is maintained in the smokable sheet via the vacuum from the vacuum slot holding the smokable sheet on the conical form mandrel and friction between the smokable sheet squeezed between the heater unit and the conical form mandrel resisting sliding of the smokable sheet in a generally horizontal direction across the vacuum table.

FIG. 8A is a perspective view schematically the conical form mandrel 500 now having continued to rotate past the bottom dead center position, and showing that the smokable sheet 24 is now partially slid across the upper surface 930 of the vacuum table 900 revealing vacuum openings 940 on the vacuum table 900. FIG. 8B is a sectional view taken through lines 8B-8B of FIG. 8A schematically indicating, while the upper surface 930 of vacuum table 900 remains at the third vertical position 984, the conical form mandrel 500, with vacuum being pulled through the vacuum slot 530 (schematically indicated by arrows 506), is rotating (schematically indicated by arrow 598') and pulling the smokable sheet 24 (schematically indicated by arrow 40) from the upper surface 930 of vacuum table 900 while tension is maintained in the smokable sheet 24 via the vacuum from the vacuum slot 530 holding the smokable sheet 24 on the conical form mandrel 500 and friction between the smokable sheet 24 squeezed between the heater unit 1100 (schematically indicated by arrows 1140 and caused by compression of plurality of springs 1030 supporting heater 1110) and the conical form mandrel 500 resisting sliding of the smokable sheet 24 in a generally horizontal direction across the upper surface 930 of the vacuum table 900. Arrow 885 schematically indicates that the sheet 24 is being squeezed between recessed area 1130 of heating unit 1100 and exterior surface of conical form mandrel.

Figure 8C:
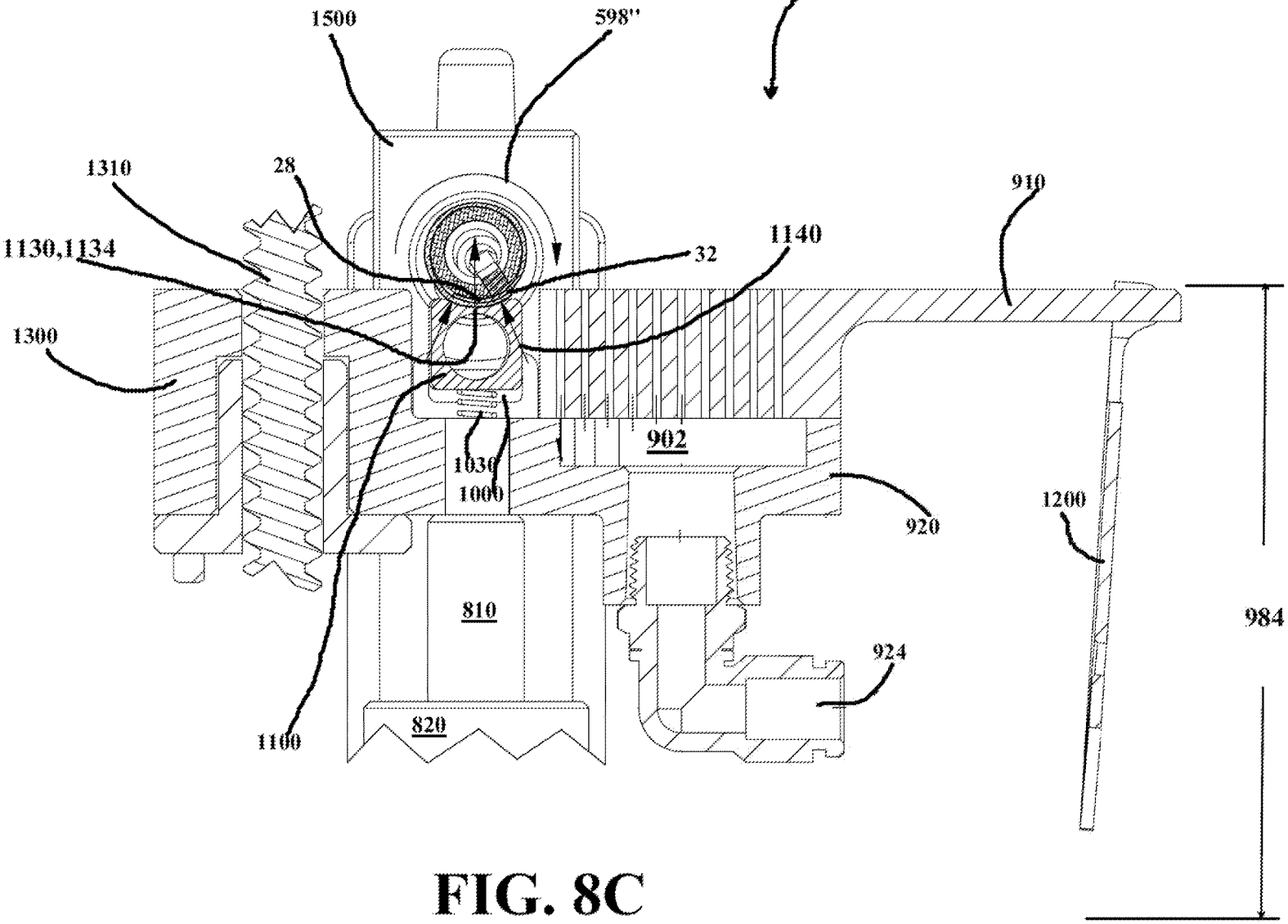
FIG. 8C. Sectional view taken through lines 8B-8B of FIG. 8A schematically indicating continued rotation of the conical form mandrel pulling the smokable sheet from the vacuum table while tension is being maintained in the smokable sheet based on the friction created by the sheet being squeezed between the heater unit and the conical form mandrel.

FIG. 8C is a sectional view taken through lines 8B-8B of FIG. 8A schematically indicating continued rotation of the conical form mandrel 500 (schematically indicated by arrow 598") pulling the smokable sheet 24 from the upper surface 930 of the vacuum table 900 while tension is being maintained in the smokable sheet 24 based on the friction created by the sheet 24 being squeezed between the heater unit 1100 and the conical form mandrel 500 (schematically indicated by arrows 1140).

Figure 9A:
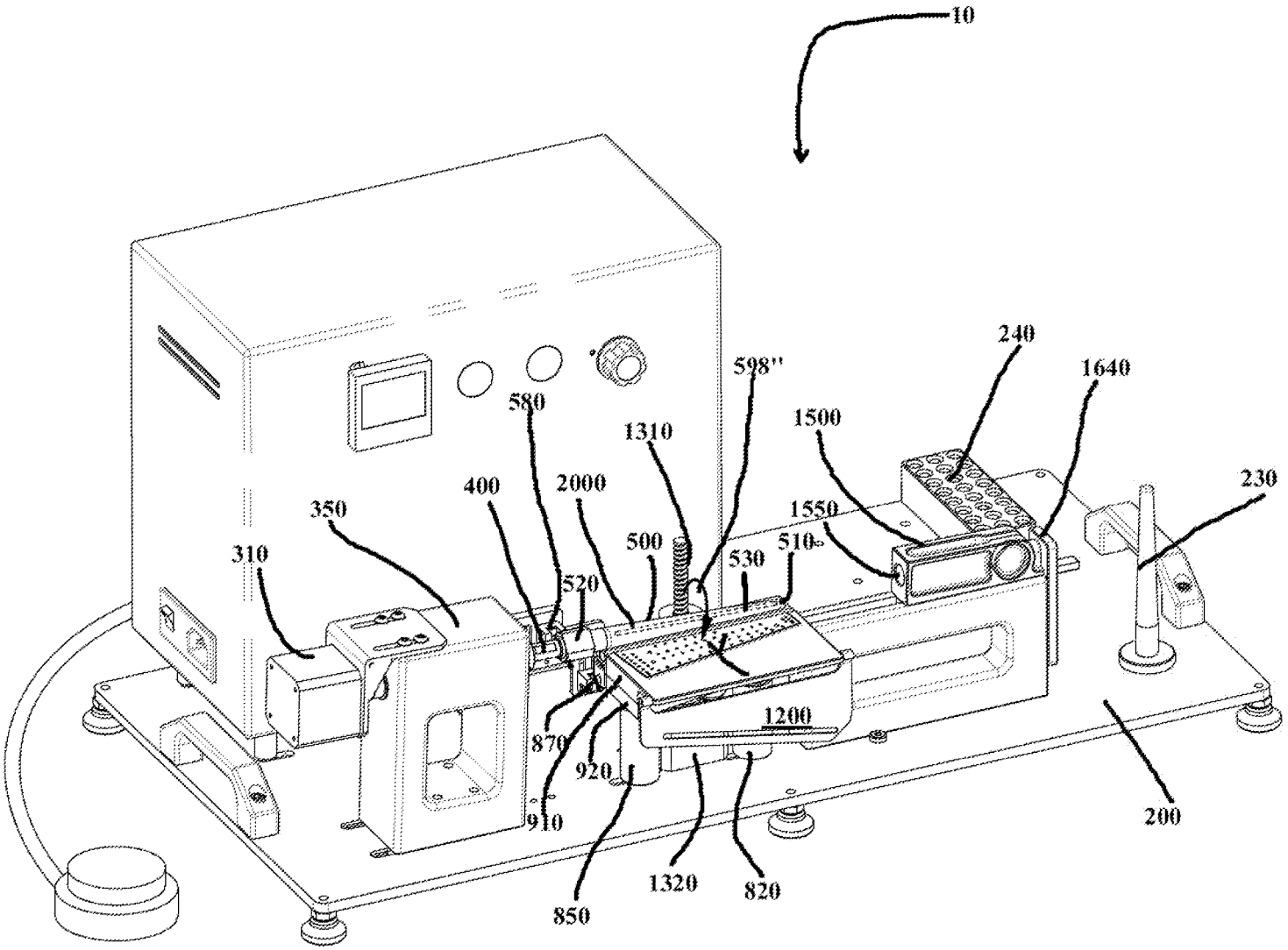
FIG. 9A. Front perspective view schematically showing the conical form mandrel now having continued to rotate over 360 degrees to completely roll the smokable sheet over the conical form mandrel while tension is being maintained in the smokable sheet based on the friction created by the sheet being squeezed between the heater unit and the conical form mandrel FIG. 9B. Rear perspective view schematically showing the conical form mandrel now having continued to rotate over 360 degrees to completely roll the smokable sheet over the conical form mandrel while tension is being maintained in the smokable sheet based on the friction created by the sheet being squeezed between the heater unit and the conical form mandrel FIG. 10. Perspective view showing vacuum table moves vertically down to lowest home position or first vertical position allowing cone garage to be slid over conical form mandrel with rolled smokable sheet.

FIG. 9A is a front perspective view schematically showing the conical form mandrel 500 now having continued to rotate over 360 degrees (schematically indicated by arrow 598") to completely roll the smokable sheet 24 over the conical form mandrel 500 while tension is being maintained in the smokable sheet 24 based on the friction created by the sheet 24 being squeezed between the heater unit 1100 and the conical form mandrel 500 (schematically indicated by arrows 1140).

Figure 9B:
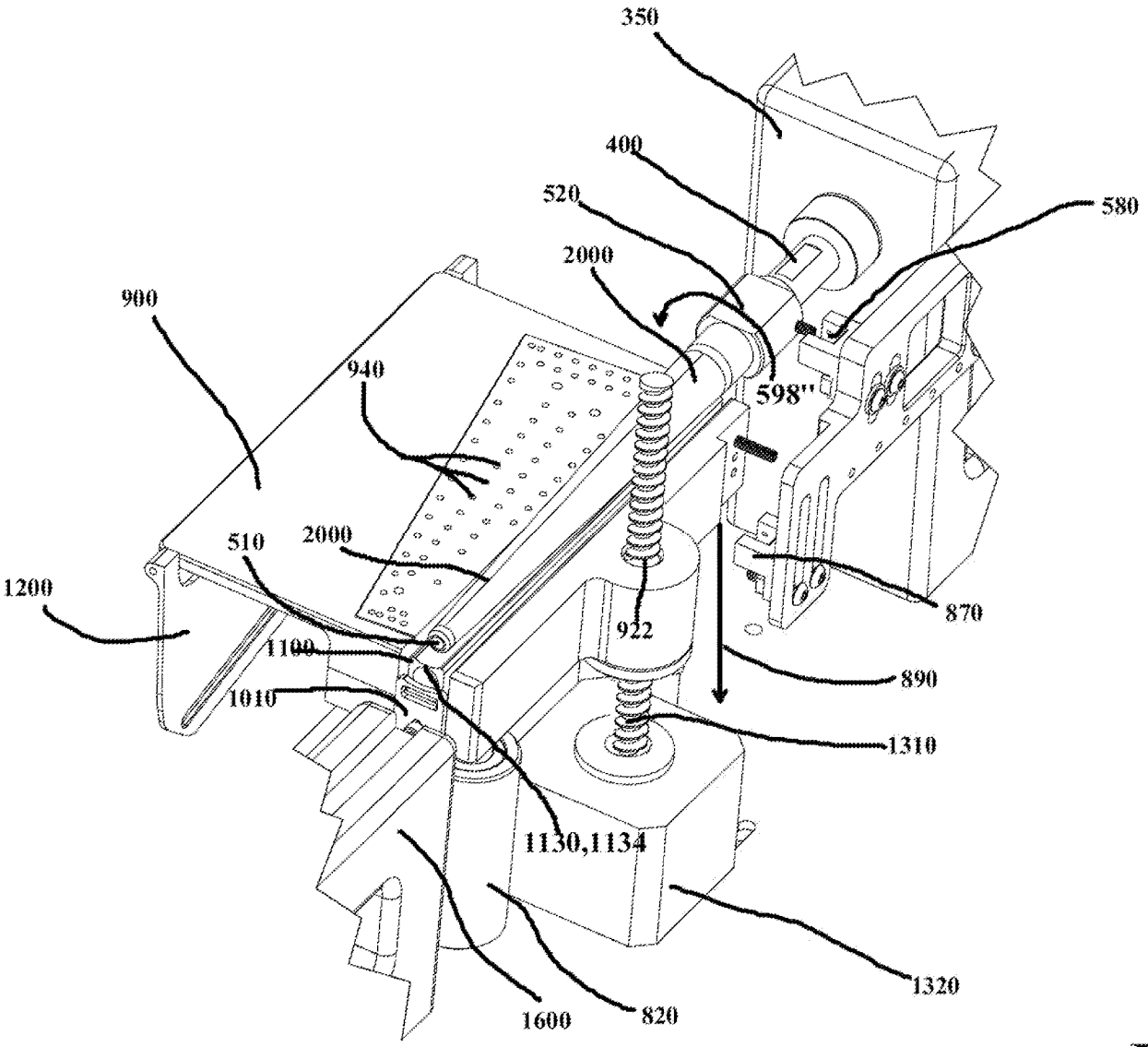

FIG. 9B is a rear perspective view schematically showing the conical form mandrel 500 now having continued to rotate over 360 degrees (schematically indicated by arrow 598") to completely roll the smokable sheet 24 over the conical form mandrel 500 while tension is being maintained in the smokable sheet 24 based on the friction created by the sheet 24 being squeezed between the heater unit 1100 and the conical form mandrel 500 (schematically indicated by arrows 1140).

In one embodiment, from the vacuum slot 530 reaches the bottom dead center position controller 100 causing vacuum to be pulled through vacuum slot 530 causing sheet 24 to be connected to conical form mandrel 500, controller 100 causes conical form mandrel 500 to rotate at least 360 degrees with vacuum being pulled through vacuum slot 530. In other embodiments at least 540 degrees of rotation is made, and in other embodiments at least 720 degrees of rotation is made.

Preferably, during rotation of conical form mandrel 500 with attached sheet 24, controller 100 causes heater unit 1100 to heat rolled sheet 24 thereby forming conical shell 2000.

After the rolling and heating steps are completed forming conical shell 2000, controller 100 causes upper surface 930 of table 900 to be lowered from third vertical position 984 to a lower vertical position to provide clearance to conical shell 2000 being supported by conical form mandrel 500. In one embodiment, upper surface 930 is moved to first vertical height 980. Now a user can insert and align a blocking tip 2500 in conical shell 200.

Tip 2500 can be any of various conventionally available blocking tips and constructed of flexible materials such as paper, cardboard, and/or plastic. Tip 2500 can include a blocking interior which can be a rolled portion of the materials forming the tip, or an accordion or folded style blocking member. Tip 2500 can have a longitudinal axis and be flexible in a direction perpendicular to the longitudinal axis.

Figure 10:
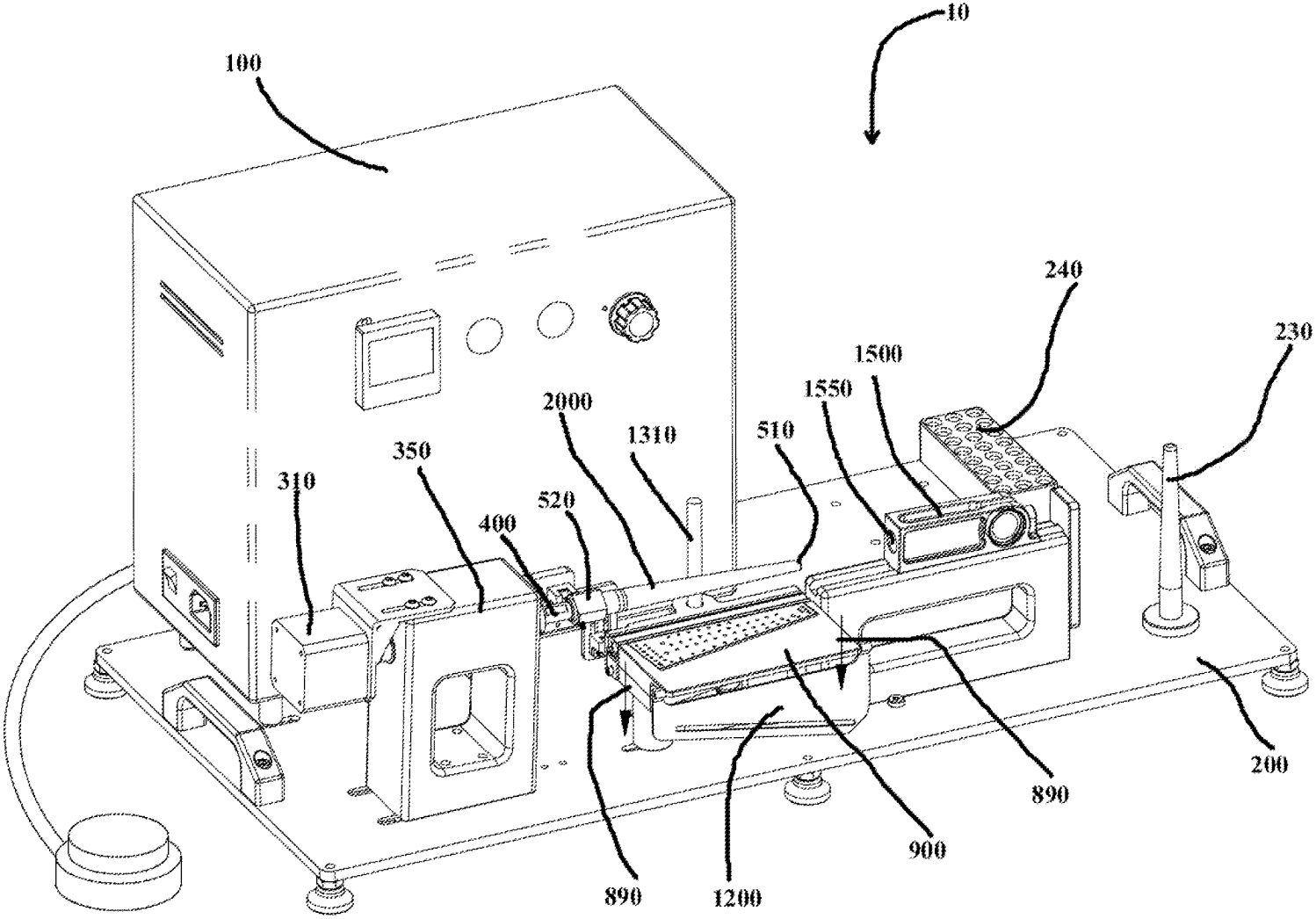

FIG. 10 is a perspective view showing upper surface 930 of vacuum table 900 moving vertically downward (schematically indicated by arrow 890) to the lowest home position or first vertical position 890 which position allowing garage carriage 1500 to be slid over conical form mandrel 500 with rolled smokable sheet or shell 2000. Garage carriage 1500 can be used to first remove conical shell 2000 from conical form mandrel 500, and second align tip 2500 with conical shell 2000.

Figure 11A:
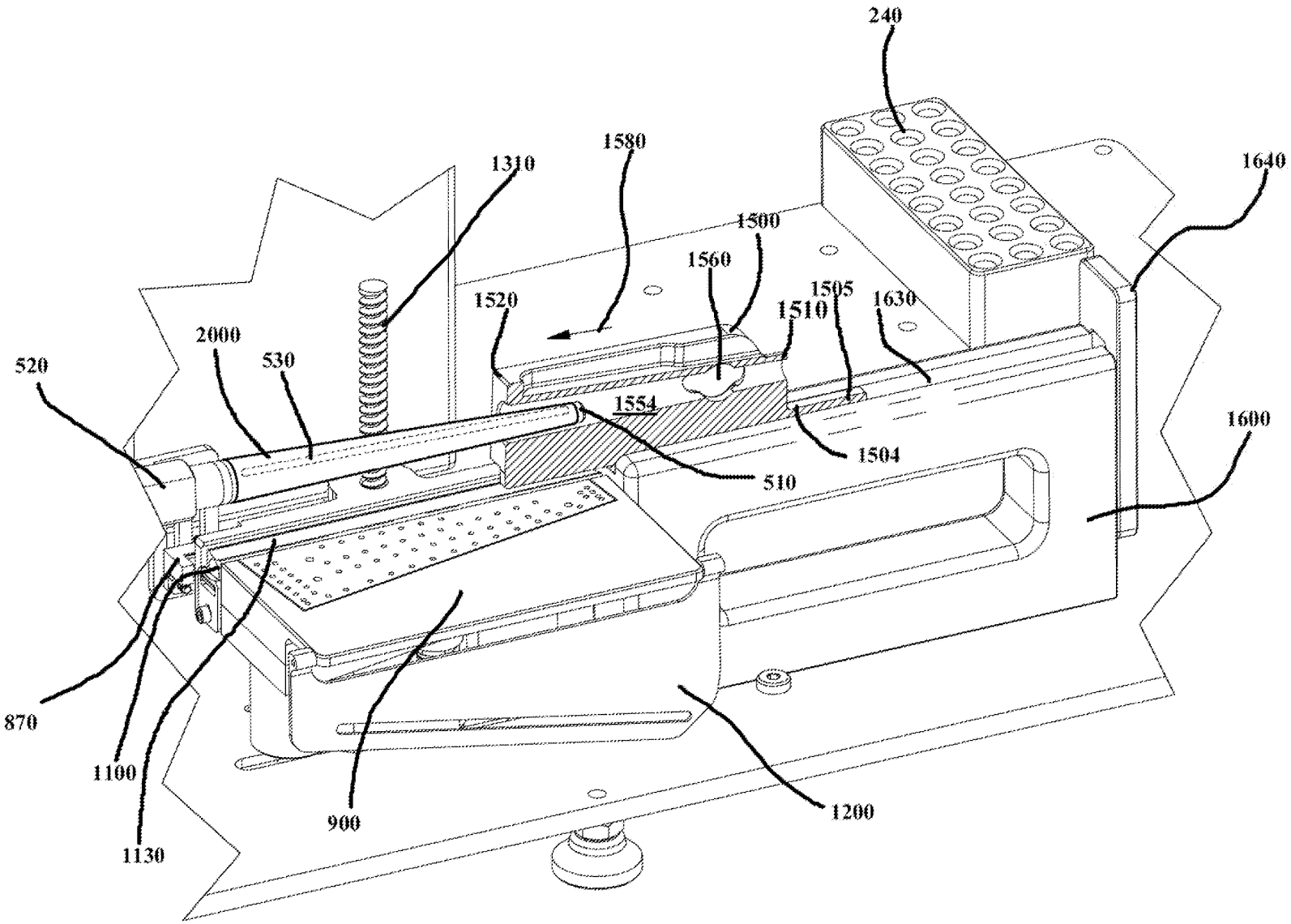
FIG. 11A. Partial cutaway perspective view showing manual cone garage being slid over rolled smokable sheet and conical form mandrel.
Figure 11B:
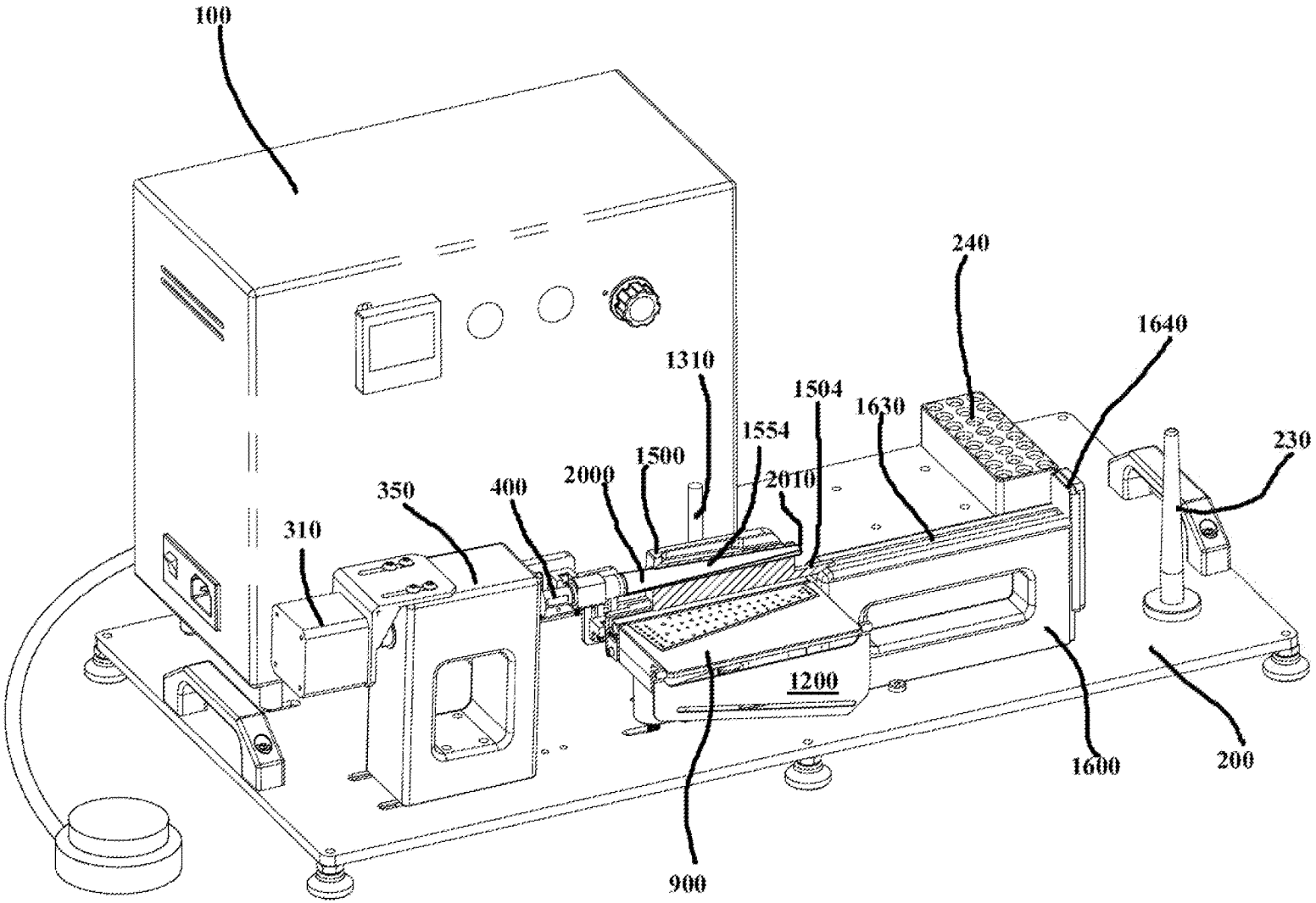
FIG. 11B. Partial cutaway perspective view showing manual cone garage slid completely over rolled smokable sheet and conical form mandrel.

FIG. 11A is a partial cutaway perspective view showing garage carriage 1500 being slid over (schematically indicated by arrow 1580) rolled smokable sheet or shell 2000 and conical form mandrel 500. FIG. 11B is a partial cutaway perspective view showing garage carriage 1500 slid completely over rolled smokable sheet or shell 2000 and conical form mandrel 500. During the sliding process guiding base of garage carriage 1500 remains supported by slot recessed area Conical shell 2000 enters and can be supported by tapered interior 1554 of garage carriage 1500. Friction between tapered interior 1554 and conical shell 2000 can be enough to remove conical shell 2000 from conical form mandrel 500. However, if not enough then user can slightly squeeze flexible grippers 1562,1572 to provide additional frictional force to remove conical shell 2000 from form mandrel 500.

Figure 12:
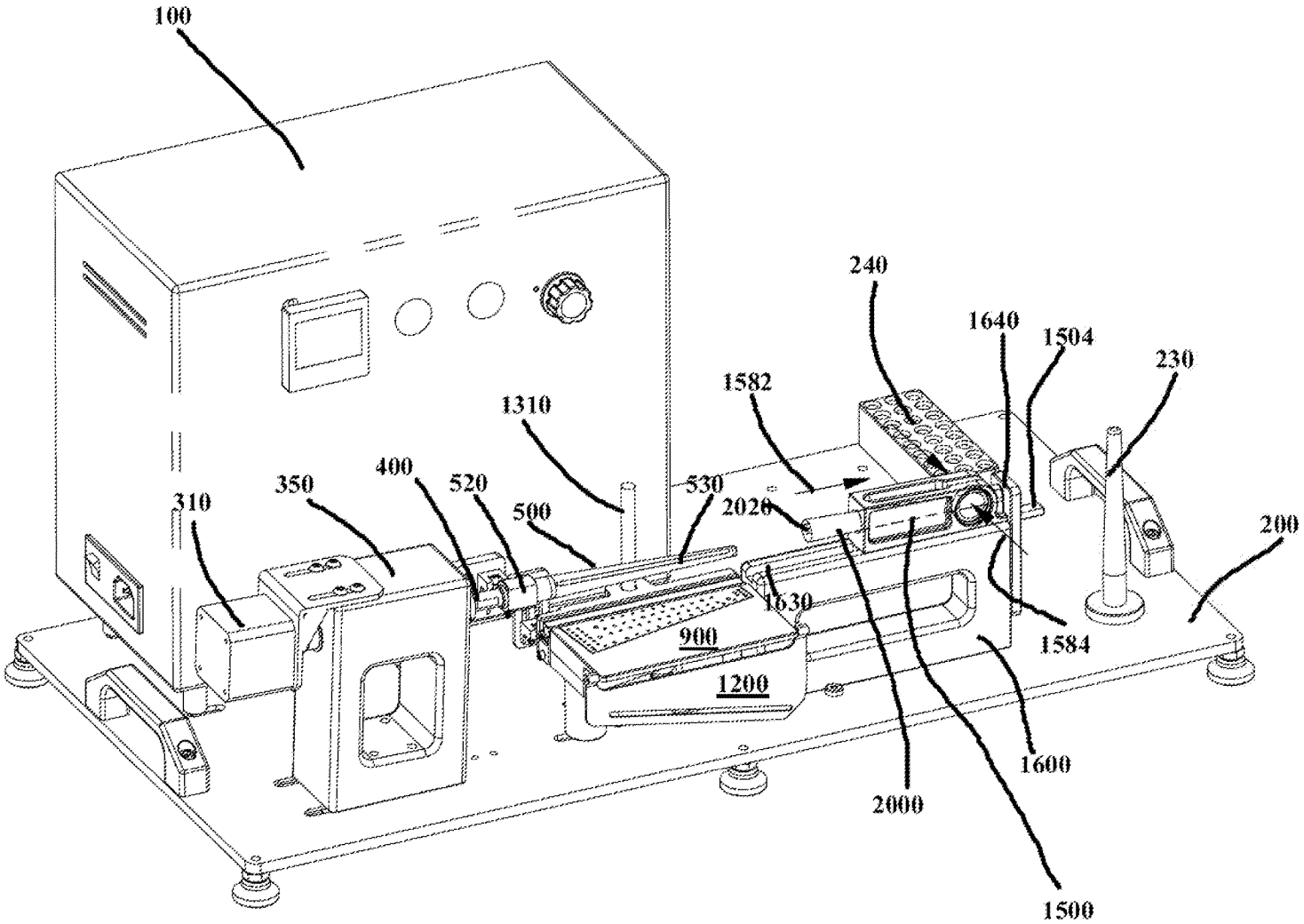
FIG. 12. Partial cutaway perspective view schematically showing the manual cone garage used to slide off the rolled smokable sheet forming a conical smoking product from the conical form mandrel which removal can be accomplished by squeezing cups on the manual garage and sliding the manual garage cone remover with rolled cone away from conical form mandrel.

FIG. 12 is a partial cutaway perspective view schematically showing the garage carriage 1500 used to slide off the rolled smokable sheet or shell 2000 from the conical form mandrel 500 which removal can be accomplished by slightly squeezing cups 1562,1572 on the garage carriage 1500 and sliding the garage carriage 1500 with rolled conical shell 2000 away from conical form mandrel 500 (schematically indicated by arrow 1582). In various embodiments the horizontal spaced between second end 2020 of conical shell 2000 and first end 510 of conical form mandrel can be at least ¼, ½, ¾, 1, 1.5, 2, 3, 4, 5, and 6 inches. In various embodiments the horizontal spacing can fall within a range of between any two of the above referenced minimum horizontal spacing amounts.

Figure 13A:
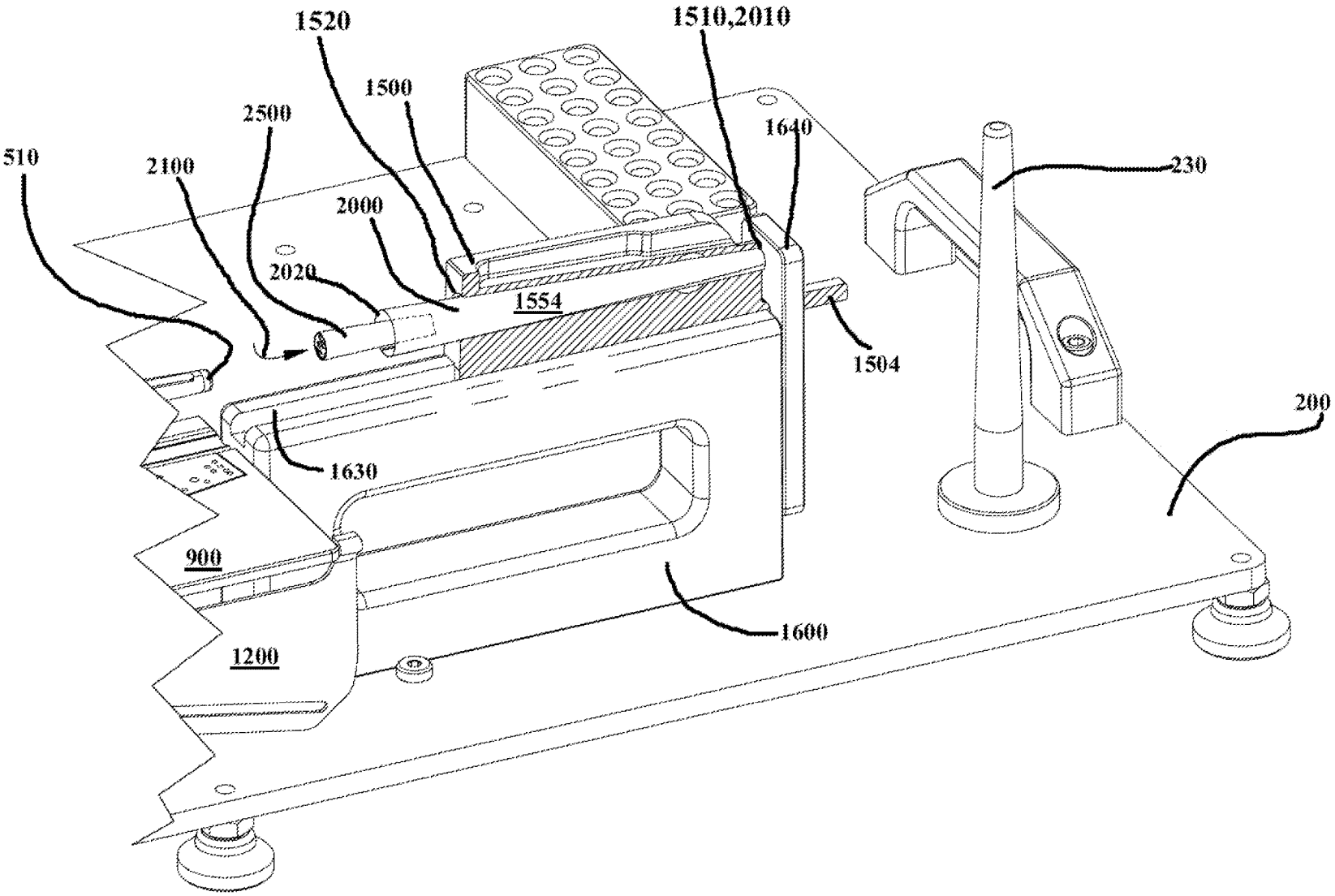
FIG. 13A. Partial cutaway perspective view schematically showing, while paper cone is being held in the manual cone garage, a tip can be placed inside the now rolled smokable cone.

FIG. 13A is a partial cutaway perspective view schematically showing, while rolled conical shell 2000 is being held in the garage carriage 1500, a tip 2500 can be placed inside the now rolled conical shell 2000 (schematically indicated by arrow 2100).

Figure 13B:
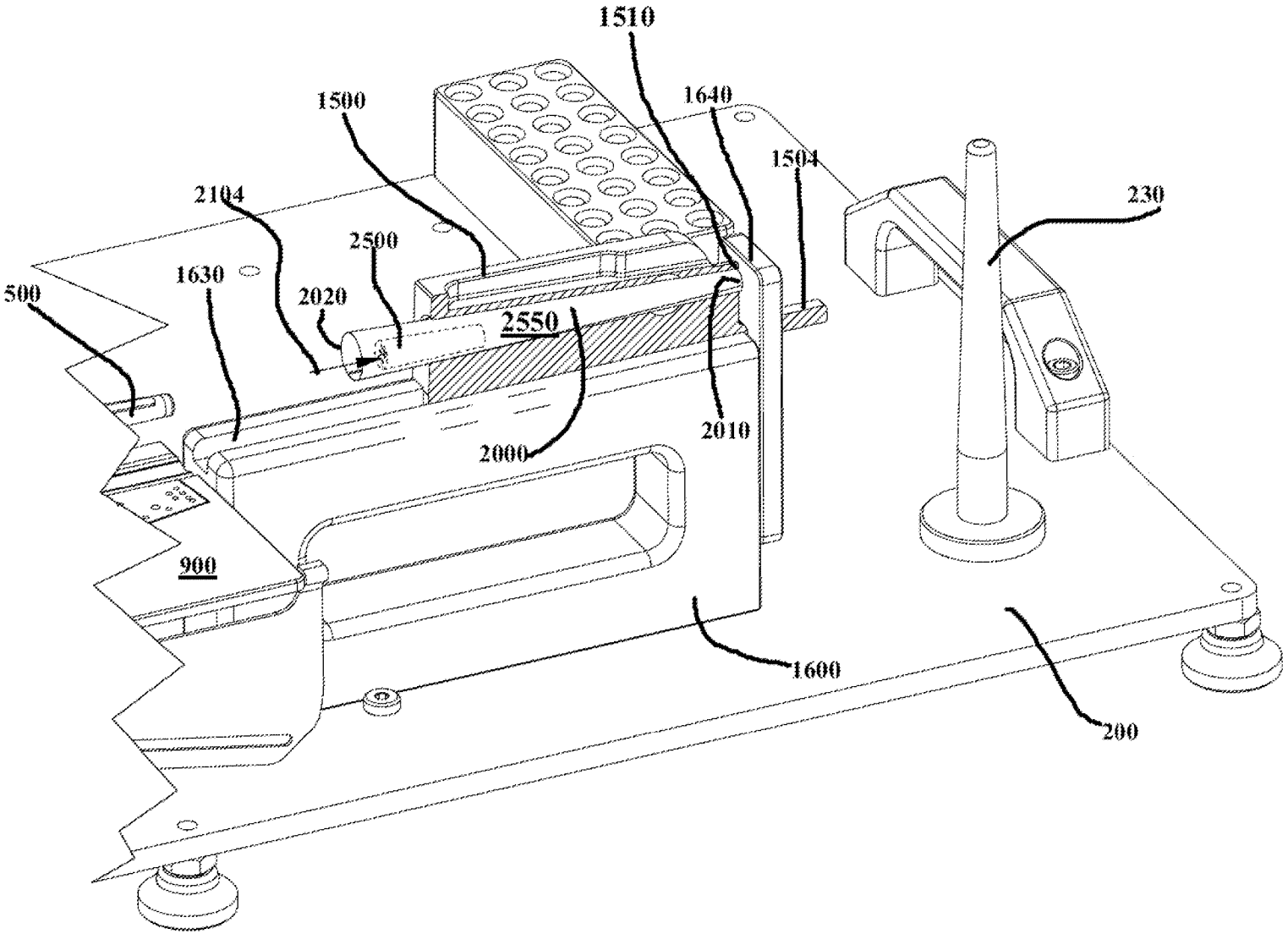
FIG. 13B. Partial cutaway perspective view schematically showing, while paper cone is being held in the manual cone garage, a tip can be placed completely inside the now rolled smokable cone.

FIG. 13B is a partial cutaway perspective view schematically showing, while conical shell 2000 is being held in the garage carriage 1500, a tip 2500 can be placed completely inside the now rolled smokable conical shell 2000 (schematically indicated by arrow 2104).

Figure 13C:
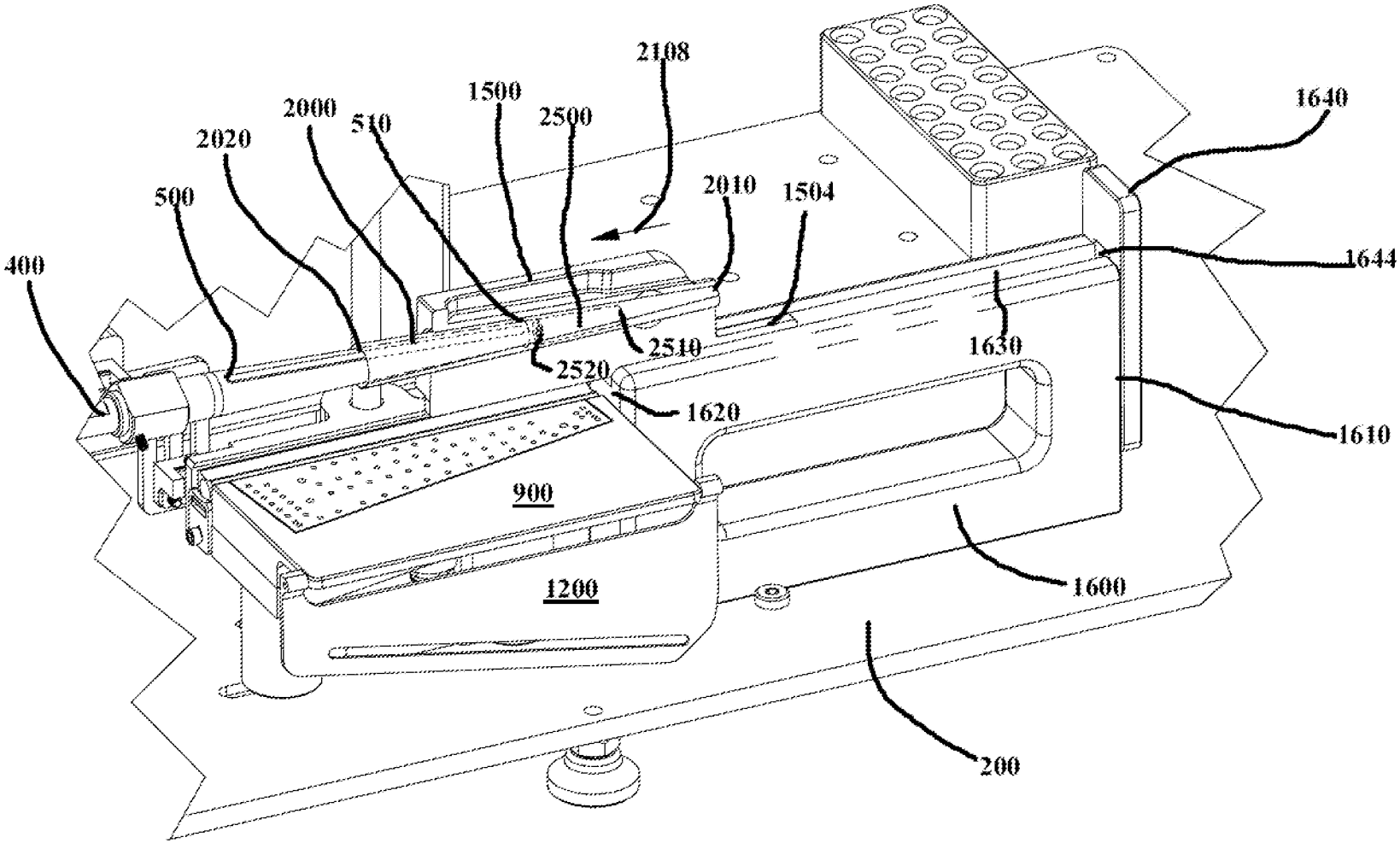
FIG. 13C. Partial cutaway perspective view schematically showing, while paper cone is being held in the manual cone garage and tip located inside the now rolled smokable cone, now rolled smokable cone with tip can be slid back over the conical form mandrel causing the conical form mandrel to contact tip and push tip towards smaller end of now rolled smokable cone.

FIG. 13C is a partial cutaway perspective view schematically showing, while conical shell 2000 is being held in the garage carriage 1500 and tip 2500 located inside interior 2550 of conical shell 2000, conical shell 2000 with tip 2500 can be slid back (schematically indicated by arrow 2108) over the conical form mandrel 500 causing the conical form mandrel 500 to contact tip 2500 and push tip 2500 towards smaller end 2010 of conical shell 2000.

Tip 2500 can have a longitudinal axis and be flexible in a direction perpendicular to the longitudinal axis. It is the flexibility in the perpendicular axis that creates friction and tends to keep tip 2500 in place relative to conical shell 2000 once located at the first or small end 2010 of conical shell 2000. In various embodiments, conical form mandrel 500 pushing on tip 2500 relative to conical shell will tend to cause a radial compression of tip 2500 (and reactant force causing radial expansion of the shell wall of conical shell where the tip 2500 is located in the interior 2040 of conical shell 2000). In various embodiments the tapered interior opening 1554 of garage carriage 1500 resists this reactant radial expansion of tip 2500 by maximizing the amount of radial expansion allowed in the wall of conical shell 2000 thereby protecting the shell wall from tearing.

Figure 14:
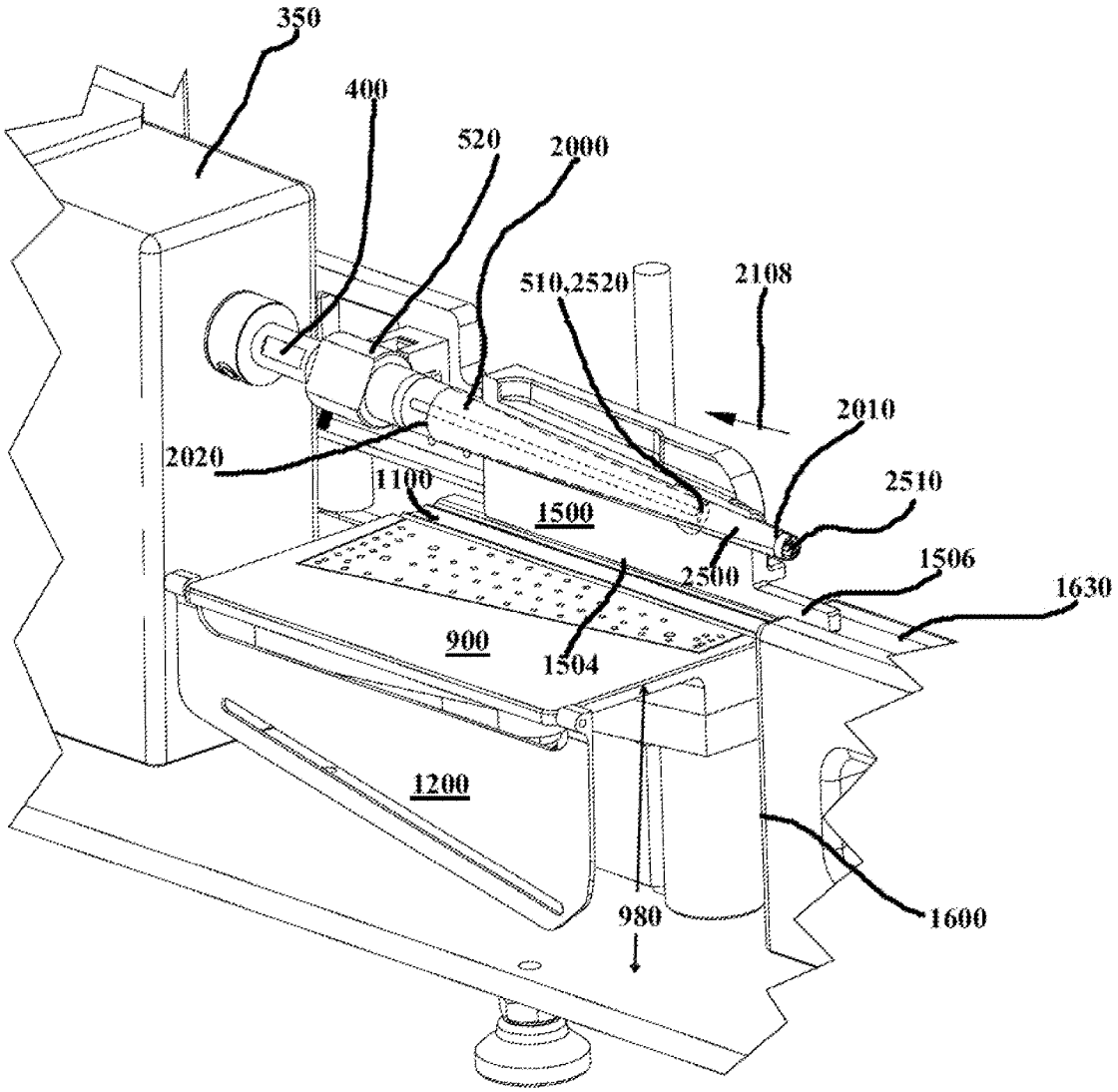
FIG. 14. Partial cutaway perspective view showing manual cone garage remover with smokable cone and tip being slid over conical form mandrel to such an extent that tip has partially exited the smaller end of the now rolled smokable cone (here tip will be pushed partially through small end).

FIG. 14 is a partial cutaway perspective view showing garage carriage 1500 with conical shell 2000 and tip 2500 being slid over conical form mandrel 500 (schematically indicated by arrow 2108) to such an extent that first end 510 of conical form mandrel 500 causes tip 2500 to partially exit the smaller end 2010 of conical shell 2000 (here tip 2500 will be pushed partially through small end 2010 of conical shell 2000).

In various embodiments the amount of small end 2010 extrusion between small end 2010 of conical shell 2000 and first end 2510 of garage carriage 2510 can be at least 1/32, 1/16, ¼, and ½ inches. In various embodiments the amount of small end 2010 extrusion can fall within a range of between any two of the above referenced minimum amounts of small end 2010 extrusion.

In various embodiments the amount of tip extrusion 2530 between tip 2500 and smaller end 2010 of conical shell 2000 can be at least 1/32, 1/16, ¼, ½, ¾, and 1 inches. In various embodiments the amount of tip extrusion 2530 can fall within a range of between any two of the above referenced minimum amounts of extrusion.

In various embodiments the amount of tip extrusion 2530 is reduced from one of the larger amounts of tip extrusion specified above to an amount that is no more than 1/32, 1/16, and ¼ inches of tip extrusion 2530. In various embodiments the reduced amount of tip extrusion 2530 can fall within a range of between any two of the above referenced reduced amounts of tip extrusion 2530.

Figure 15A:
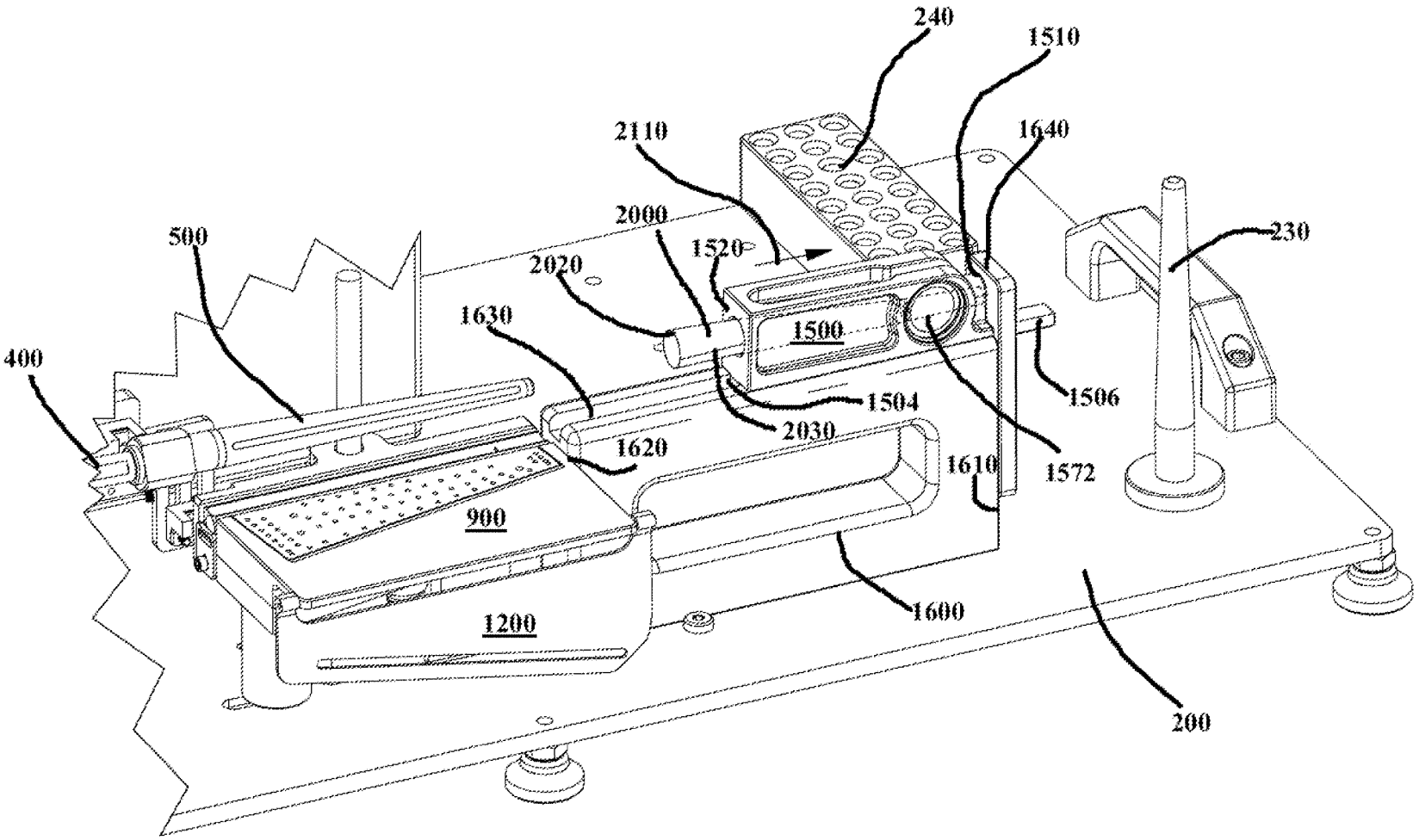
FIG. 15A. Perspective view schematically indicating manual garage cone remover with smokable cone and positioned tip being slid away from conical form mandrel and towards stopper of base to now position tip substantially flush with end of smokable cone.

FIG. 15A is a perspective view schematically indicating garage carriage 1500 with conical shell 2000 and now positioned tip 2500 being slid away (schematically indicated by arrow 2110) from conical form mandrel 500 and towards stopper 1640 of base 1600 to now position tip 2500 substantially flush with first end 2010 of conical shell 2000.

Figure 15B:
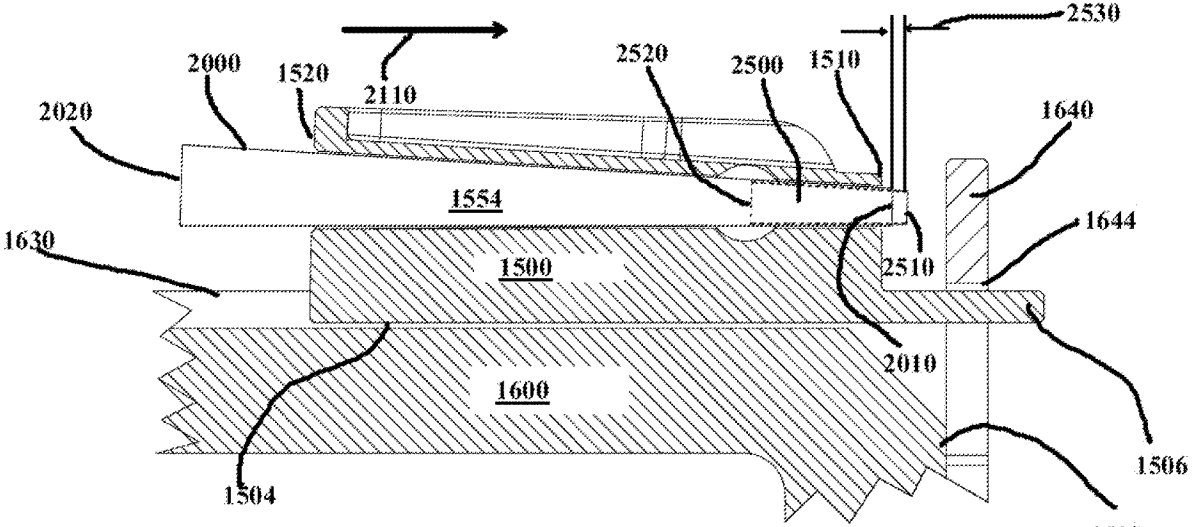
FIG. 15B. Sectional view showing manual garage cone remover with smokable cone and positioned tip approaching stopper of base.

FIG. 15B is a sectional view showing garage carriage 1500 with conical shell 2000 and positioned tip 2500 approaching stopper 1640 of base 1600.

Figure 15C:
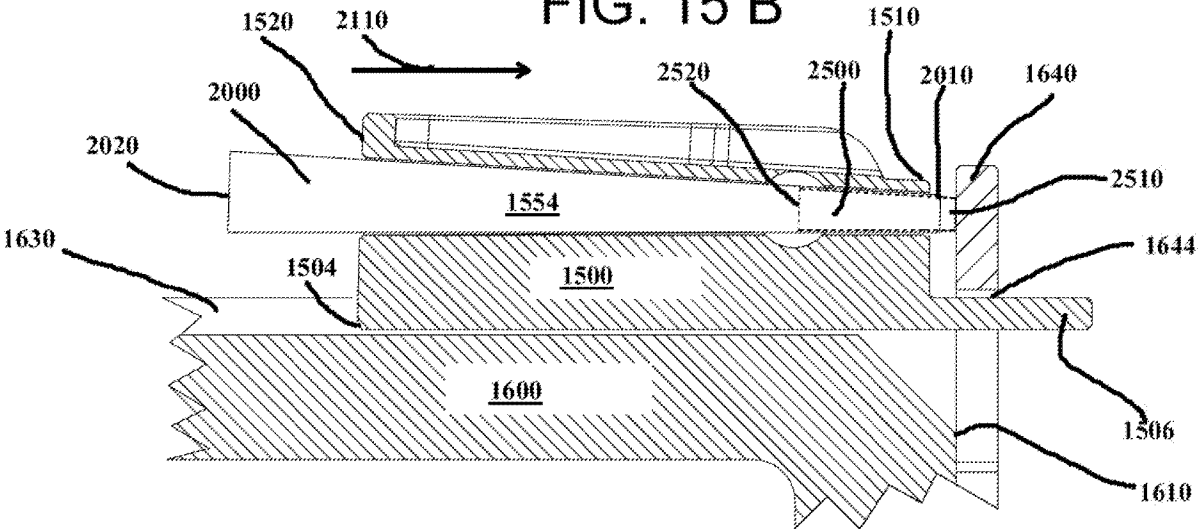
FIG. 15C. Sectional view showing manual garage cone remover with smokable cone and positioned tip first contacting stopper of base, where small end of smokable cone extending past the end of manual garage cone remover and tip extending past small end of smokable cone.

FIG. 15C is a sectional view showing garage carriage 1500 with conical shell 2000 and positioned tip 2500 first contacting stopper 1640 of base 1600, where small end 2010 of conical shell 2000 extending past the first end 1510 of garage carriage 1500, wherein tip 2500 extending past first or small end 2010 of conical shell 2000.

Figure 15D:
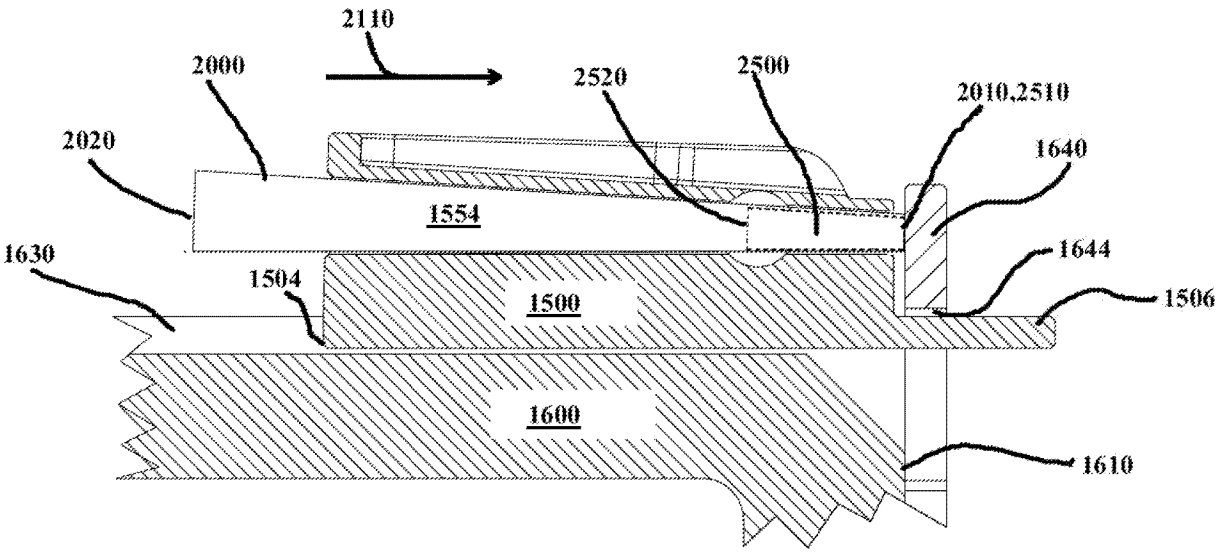
FIG. 15D. Sectional view showing tip being moved to be flush with small end of conical smokable cone, but with the small end of smokable cone extending past the end of manual garage cone remover and tip being now flush with small end of smokable cone.

FIG. 15D is a sectional view showing tip 2500 being moved to be flush with first or small end 2010 of conical shell 2000, but with the first or small end 2010 of conical shell 2000 itself extending past the first end 1510 of garage carriage 1500 and tip 2500 being now flush with first or small end 2010 of conical shell 2000.

Figure 15E:
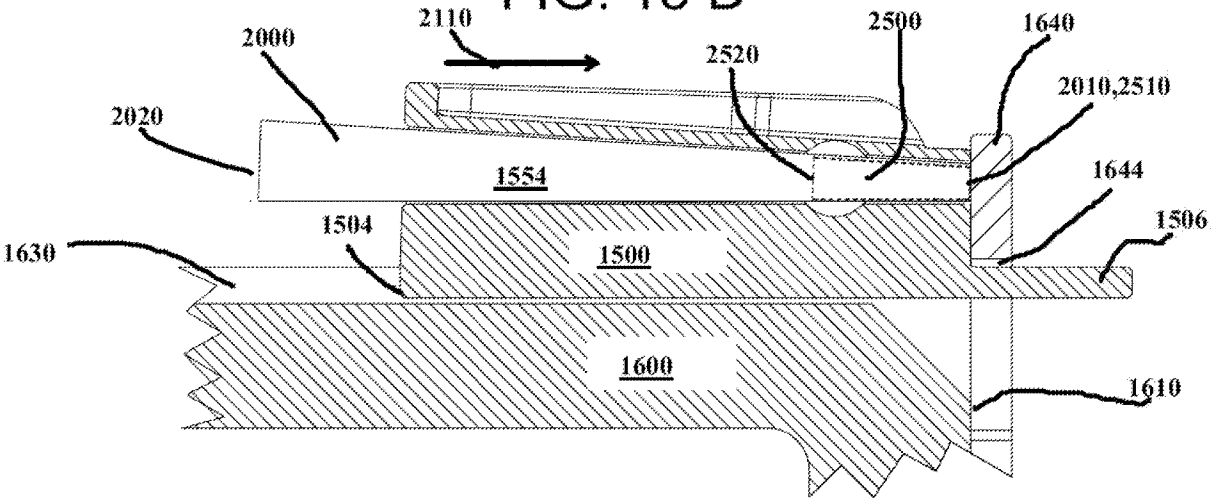
FIG. 15E. Sectional view showing tip being moved to be flush with small end of conical smokable cone with the small end of smokable cone and tip now both being flush with end of manual garage cone remover.

FIG. 15E is a sectional view showing tip 2500 being moved to be flush with first or small end 2010 of conical shell 2000 and with the first or small end 2010 of conical shell 2000 and tip 2500 now both being flush with first end 1510 of garage carriage 1500.

Figure 16:
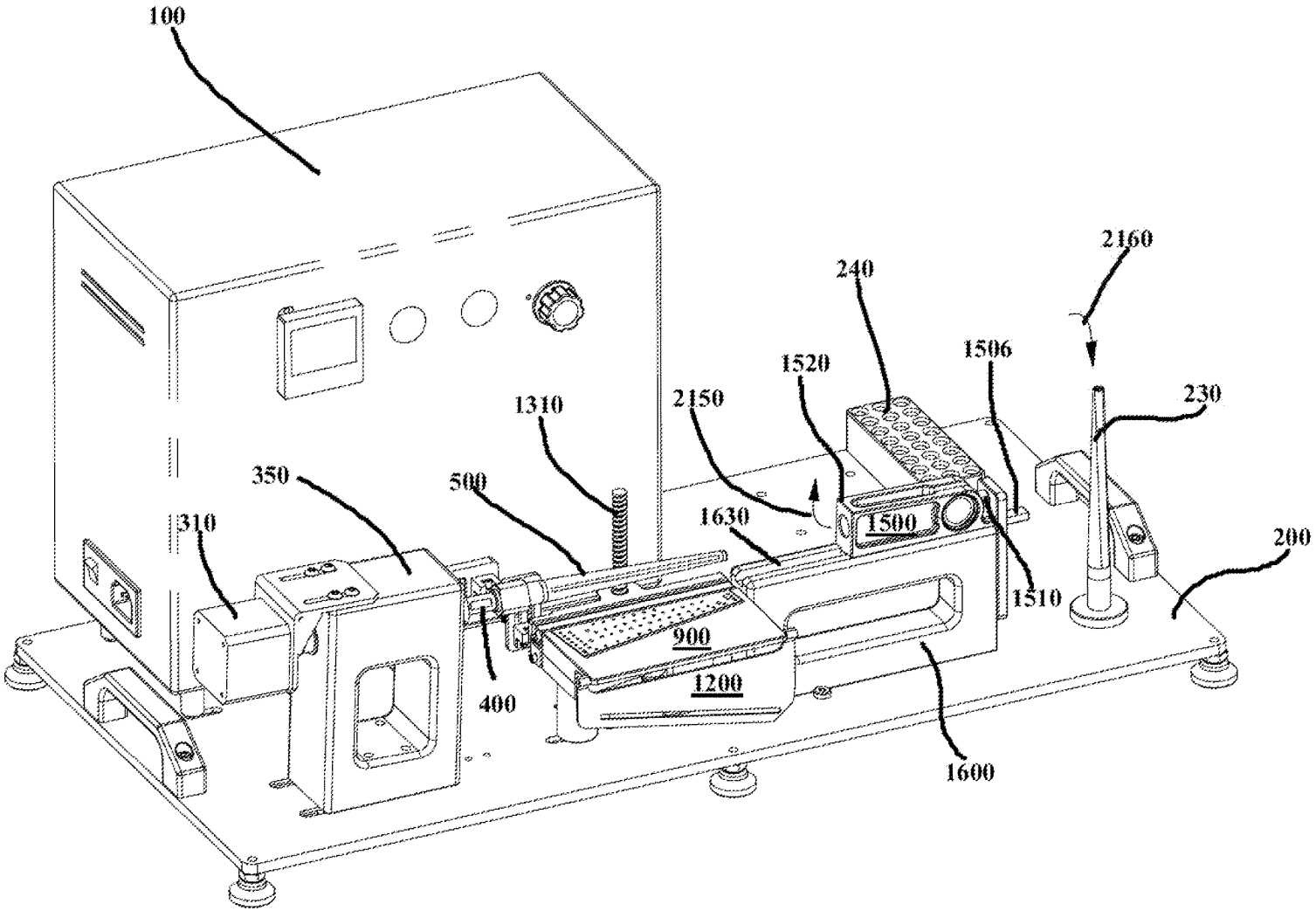
FIG. 16. Perspective view schematically indicating that the smokable cone with tip from FIG. 15E can be removed from manual garage cone remover and store manufactured smokable cone onto vertical prong.

FIG. 16 is a perspective view schematically indicating that conical shell 2000 with tip 2500 can now be removed from garage carriage 1500 and then placed onto vertical prong 230 (schematically indicated by arrow 2160).

REFERENCE NUMERAL LIST

Reference No. Description

5 method and apparatus
10 rolling machine
18 user/operator
20 stack of smokable sheets
24 sheet pulled from stack
28 first edge

30 raised portion between first edge and second edge
32 second edge
36 glue line
40 arrow
100 controller
110 foot pedal
120 speed control
130 home button
140 temperature display
150 on/off switch
160 on/off indicator
200 base
210 plurality of legs
220 plurality of handles
230 finished cone caddy
240 storage caddy
300 rolling unit
310 step motor
312 shaft
316 mount for motor
320 coupling between motor shaft and form mandrel shaft
350 base
360 main bore
364 connecting bore
370 inlet
375 set screw to seal bore
380 bearings/seals
382 washers
384 collar
400 rotatable form mandrel shaft
402 angle of inclination from horizontal
410 first end
420 second end
422 threaded area
430 interior bore
440 plurality of openings
450 collar
460 coupling
500 conical form mandrel
501 longitudinal axis
502 angle of longitudinal axis of mandrel relative to the horizontal plane
504 interior
506 arrows
510 first end
512 diameter of first end
514 base
515 threaded area
520 second end
520 diameter of second end
530 vacuum slot
540 permeable insert for vacuum slot
550 exterior surface
560 length
570 taper along length of mandrel
580 rotation sensor
581 rotation sensor element
590 arrow
591 arrow
594 angle of rotation theta
595 second angle of rotation theta 2
596 third angle of rotation theta 3
598 arrow
599 arrow
600 vacuum system
800 table unit
810 first telescoping leg
820 support for first telescoping leg
830 bearings for first leg
840 second telescoping leg
850 support for second telescoping leg
860 bearings for second leg
870 vertical height sensor
872 sensor element
880 arrows
881 arrows
882 arrows
884 arrow
885 arrow
886 arrows
890 arrow
900 table unit
902 table vacuum plenum
910 upper portion
920 lower portion
922 threaded bore
924 inlet
930 upper surface
940 plurality of vacuum openings in upper surface
941 plurality of arrows indicating vacuum being pulled
950 plenum volume
960 vacuum system
980 first vertical height
982 second vertical height
984 third vertical height
1000 recess for heater
1010 retaining plate
1012 opening
1014 fastener
1020 retaining plate
1022 opening
1024 fastener
1030 plurality of springs
1100 heater unit
1110 first end
1112 prong
1120 second end
1122 prong
1130 recessed area
1134 radius of curvature for recessed area
1140 arrows
1144 arrows
1200 pivoting retaining plate for smokable sheet
1210 slot in retaining plate for glue line
1212 arrow
1220 arrow
1300 vertical control lifting section
1310 threaded shaft
1320 motor
1490 garage system
1500 caddy unit or garage carriage
1504 guiding base
1506 extension
1510 first end
1520 second end
1550 tapered interior opening
1552 small opening to interior taper
1554 tapered interior
1555 longitudinal axis
1556 angle of inclination
1559 squeezing system
1560 first opening
1562 flexible gripper
1570 second opening

1572 flexible gripper
1580 arrow
1582 arrow
1584 arrow
1590 window
1592 window
1594 window
1600 base for caddy
1610 first end
1620 second end
1630 slot/recessed area
1640 stopper plate
1644 opening
2000 pre-rolled conical smoking shell
2010 first end
2020 second end
2030 seam
2040 interior
2100 arrow
2104 arrow
2108 arrow
2110 arrow
2150 arrow
2160 arrow
2500 pre-formed tip
2510 first end
2520 second end
2530 gap
2550 interior All measurements disclosed herein are at standard temperature and pressure, at sea level on Earth, unless indicated otherwise. All materials used or intended to be used in a human being are biocompatible, unless indicated otherwise.

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

The invention claimed is:

1. A method of making a custom made cigar comprising the steps of:

(a) providing an apparatus which forms conically shaped smoking shells having blocking tips, the apparatus including:
  (i) a conical form mandrel having an exterior surface, an interior section, and a vacuum opening fluidly connecting the interior section with the exterior surface;
  (ii) a motor operably connected to the conical form mandrel which can rotate the conical form mandrel;
  (iii) a conical form mandrel vacuum system operably connected to the interior section of the conical form mandrel;
  (iv) a vacuum table having an upper surface, a vertical elevation system operably connected to the upper surface, which vertical elevation system vertically positions the upper surface, and a table vacuum system operably connected to the upper surface;
  (v) a garage system located next to the conical form mandrel, the garage system including a base and a garage carriage slidingly connected to the base, the garage carriage including first and second ends with an internal opening extending from the first to the second end, an a squeeze lock connected to the garage carriage;

(b) providing a plurality of sheets of smokable material;

(c) providing a plurality of blocking tips;

(d) selecting one of the sheets of step "b" and placing the selected sheet on the upper surface of the vacuum table;

(e) the table vacuum system pulling a partial vacuum on at least part of the upper surface of the vacuum table which partial vacuum on at least part of the upper surface of the vacuum table tends to hold in place the selected sheet on the upper surface of the vacuum table;

(f) the motor rotating the conical form mandrel;

(g) the conical form mandrel vacuum system pulling a partial vacuum on at least part of the external surface of the conical form mandrel;

(h) the partial vacuum on the external surface of the conical form mandrel connecting the selected sheet of step "d" to the conical form mandrel, wherein rotation of the conical form mandrel causing the selected sheet to be wrapped about the conical form mandrel and forming a conical shell having first and second open ends and a shell interior spanning between the first and second open ends of the conical shell;

(i) after step "h", sliding the garage in a first direction over the conical form mandrel and the conical sheet thereby causing the conical form mandrel and conical shell to at least partly enter the interior opening of the garage carriage;

(j) after step "i", while the conical shell remains at least partly located in the interior opening of the garage carriage, sliding the garage in a second direction, which second direction is generally the opposite of the first direction, thereby causing the conical shell to be separated from the conical form mandrel;

(k) after step "j", selecting one of the blocking tips from step "c", and placing the selected blocking tip inside the shell interior and, while the conical shell remains at least partly located in the interior opening of the garage carriage, sliding the garage carriage in the first direction such that the conical form mandrel enters the interior of the conical shell causing the selected tip to move towards the second end of the conical shell; and (l) after step "k", while the conical shell remains at least partly located in the interior opening of the garage carriage, sliding the garage in the second direction thereby causing the selected tip to become aligned with the second end of the conical shell.

2. The method of claim 1, wherein in step "a", the conical form mandrel includes a vacuum slot and the conical form mandrel vacuum system is operably connected to the vacuum slot.

3. The method of claim 2, wherein the vacuum slot includes a foraminous slot filler which allows vacuum flow through the foraminous slot filler.

4. The method of claim 1, wherein steps "f", "g", and "f" are performed simultaneously, and during steps "f", "g", and "h", the motor rotates the conical form mandrel at least one revolution when.

5. The method of claim 1, wherein during step "h" the selected sheet is heated with a heater.

6. The method of claim 1, wherein step "e" is started before step "h", and before the end of step "h", the partial vacuum on at least part of the upper surface of the vacuum table is ended.

7. The method of claim 1, wherein during step "b" the plurality of sheets are stacked and each of the sheets in the plurality of sheets include a line of adhesive, and during step "e" the line of adhesive on the selected sheet is activated by application of an activator to the line of adhesive.

8. The method of claim 7, wherein activation of the adhesive is achieved by application of water to the line of adhesive.

9. The method of claim 7, wherein a glue line guide is placed over the selected sheet which contacts the selected sheet but allows access to the glue line.

10. The method of claim 9, wherein the glue line guide is pivotally connected to the vacuum table.

11. The method of claim 1, wherein the vacuum table in step "h" has a first height, and the vacuum table in step "i" has a second height, and the first height is higher than the second height.

12. The method of claim 11, wherein the vacuum table remains at the second height during steps "i", "j", and "k".

13. The method of claim 11, wherein the vacuum table remains at the second height during steps "i", "j", "k", and "l".

14. The method of claim 1, wherein during step "a" the garage base includes a slot, and during steps"i", "j", "k", and "l", the garage carriage is guided by the slot.

15. The method claim 1, wherein during step "a" the garage base includes a slot, the garage carriage includes a slot plate, and during steps"i", "j", "k", and "l", the slot plate remains in the slot.

16. The method claim 1, wherein during step "a" the garage base includes a slot, the garage carriage includes a slot plate which slides in the slot of the garage base, the internal opening of the garage carriage includes first and second opening outlets respectively located at the first and second ends of the garage carriage, wherein the first outlet is larger than the second outlet, and the slot plate extends past the second end of the garage carriage.

17. The method of claim 16, wherein the garage base includes first and second ends, and a garage stop located at the second end of the garage base, and when the second end of the garage carriage is in contact with the garage stop, the slot plate extends past the second end of the garage base and past the garage stop.

18. The method of claim 1, wherein during step "a" the garage base includes a slot, the garage carriage includes a slot plate which slides in the slot of the garage base, the internal opening of the garage carriage includes first and second opening outlets respectively located at the first and second ends of the garage carriage, wherein the first outlet is larger than the second outlet, and wherein during step "k" the second end of the conical shell is caused to extend past the second opening outlet of the garage carriage.

19. The method of claim 1, wherein during step "a" the garage base includes a slot, the garage carriage includes a slot plate which slides in the slot of the garage base, the internal opening of the garage carriage includes first and second opening outlets respectively located at the first and second ends of the garage carriage, wherein the first outlet is larger than the second outlet, and wherein during step "k" the second end of the conical shell is caused to extend past the second opening outlet of the garage carriage, and the blocking tip partially extends past the second end of the conical shell.

20. The method of claim 19, wherein during step "l", contact with the second end of the conical shell is made to be flush with second opening of the garage carriage.

* * * * *